US007787792B2

(12) United States Patent
Nishida

(10) Patent No.: US 7,787,792 B2
(45) Date of Patent: Aug. 31, 2010

(54) HEATING APPARATUS AND IMAGE FORMING APPARATUS WITH FIXING TREATING MODES FOR PERIODS BETWEEN IMAGE FIXING

(75) Inventor: Satoshi Nishida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 11/962,317

(22) Filed: Dec. 21, 2007

(65) Prior Publication Data

US 2008/0107437 A1 May 8, 2008

Related U.S. Application Data

(62) Division of application No. 11/213,992, filed on Aug. 30, 2005.

(30) Foreign Application Priority Data

Sep. 7, 2004 (JP) ..... 2004-259916

(51) Int. Cl.
*G03G 15/20* (2006.01)

(52) U.S. Cl. ..... 399/70

(58) Field of Classification Search ..... 399/67–70
See application file for complete search history.

(56) References Cited

U.S. PATENT DOCUMENTS

| | | | | |
|---|---|---|---|---|
| 4,719,489 | A | 1/1988 | Ohkubo et al. | 399/45 |
| 5,149,941 | A | 9/1992 | Hirabayashi et al. | 219/216 |
| 5,300,997 | A | 4/1994 | Hirabayashi et al. | 355/285 |
| 5,343,280 | A | 8/1994 | Hirabayashi et al. | 355/285 |
| 5,659,844 | A | 8/1997 | Fujiwara | 399/69 |
| 5,669,039 | A | 9/1997 | Ohtsuka et al. | 399/68 |
| 5,767,484 | A | 6/1998 | Hirabayashi et al. | 219/216 |

(Continued)

FOREIGN PATENT DOCUMENTS

| | | |
|---|---|---|
| JP | 63-313182 | 12/1988 |

(Continued)

OTHER PUBLICATIONS

JP 10186909 A English abstract and figures.*

(Continued)

*Primary Examiner*—David M Gray
*Assistant Examiner*—Ruth N Labombard
(74) *Attorney, Agent, or Firm*—Fitzpatrick, Cella, Harper & Scinto

(57) ABSTRACT

The heating apparatus has a heating member and a pressure member which are mutually pressure-welded to hold and convey and heat a heated member to be heated by a nip portion formed between the heating member and the pressure member, includes a temperature detector, power control means, and a curl reduction mode for setting a paper conveyance interval temperature which is the target temperature of the heating member set in a paper conveyance interval which is a period from end of heating the M-th member to be heated up to start of heating the M+1-th member to be heated in continuous heating of N members to be heated or in a certain period in the paper conveyance interval to a temperature higher than the heating temperature of a member to be heated which is the target temperature of the heating member when heating the M+1-th member to be heated.

7 Claims, 16 Drawing Sheets

U.S. PATENT DOCUMENTS

| | | | | |
|---|---|---|---|---|
| 6,516,166 | B2 | 2/2003 | Sakakibara et al. | 399/69 |
| 6,947,679 | B2 | 9/2005 | Kato et al. | 399/45 |
| 7,130,553 | B2 | 10/2006 | Sakai | 399/68 |
| 2003/0077092 | A1 | 4/2003 | Ogawa et al. | 399/328 |
| 2005/0163523 | A1 | 7/2005 | Omata et al. | 399/69 |
| 2005/0265741 | A1 | 12/2005 | Otsuka | 300/69 |
| 2006/0051117 | A1 | 3/2006 | Nishida | 399/69 |

FOREIGN PATENT DOCUMENTS

| | | |
|---|---|---|
| JP | 6-149103 | 5/1994 |

OTHER PUBLICATIONS

Machine translation of JP 10-186909 A.*

* cited by examiner

HEATING APPARATUS AND IMAGE FORMING APPARATUS WITH FIXING TREATING MODES FOR PERIODS BETWEEN IMAGE FIXING

This is a divisional of U.S. patent application Ser. No. 11/213,992, filed Aug. 30, 2005, now pending.

BACKGROUND OF THE INVENTION

1. Field of the Invention

The present invention relates to a heating apparatus for heating a conveyed and introduced material to be heated at a heating portion and discharging the material.

More particularly, the present invention relates to a heating apparatus having mutually-pressure-welded heating member and pressure member to hold and convey a member to be heated by a nip portion formed between the heating member and the pressure member and heat the member to be heated.

Moreover, the present invention relates to an image forming apparatus such as a printer or copying machine having the heating apparatus as an image heating and fixing apparatus.

2. Description of Related Art

Hereafter, as an example, a fixing apparatus serving as a heating apparatus for heating and fixing an image in an image forming apparatus is described below.

A general fixing apparatus heats and pressure-fixes an unfixed image on a recording material (hereafter referred to as recording medium) surface by the heat of a heating member by pressure-welding the heating member and a pressure member, thereby forming a nip portion and paper-conveying the recording medium making the nip portion form and carry the unfixed image. As apparatus configurations, there are a film heating system and a roller heating system.

A fixing apparatus according to the film heating system uses an assembly having heating means (heating source) fixed and supported as a heating member and a flexible member sliding on the heating means. The heating member is constituted so as to form the heating means and fixing nip portion through the flexible member, hold and convey a recording medium for forming and carrying an unfixed image by the fixing nip portion and heat the recording medium by the heat of the heating means through the flexible member.

More specifically, the heating means generally uses the so-called ceramic heater which has a low thermal capacity and quick temperature rise. The flexible member uses a thin film (hereafter referred to as film) having a single layer configuration or compound layer configuration based on high-temperature resin or metal. Moreover, the fixing nip portion is formed by making the fixed and supported ceramic heater hold the film and pressure-welding the pressure roller to slide the film on the ceramic heater surface at the fixing nip portion. In the case of this configuration, the heat of the ceramic heater is supplied to a recording medium through the film by introducing the recording medium between the film of the fixing nip portion and the pressure roller and making the recording medium pass through the fixing nip portion together with the film.

In the case of the ceramic heater serving as heating means, an exothermic resistor which produces heat through electrification is set to one side of a thin-plate substrate mainly containing ceramic and a thermistor sensor (hereafter referred to as thermistor) serving as a temperature detector contacts with the other side of the substrate.

The fixing apparatus according to the roller heating system uses a cylindrical heat roller (hereafter referred to as fixing roller) having heating means such as a halogen heater at the inside or outside. The fixing nip portion is formed by pressure-welding a pressure roller serving as a heating member to the fixing roller and the recording medium is heated by the heat of the fixing roller by introducing a recording medium between the fixing roller and the pressure roller. A thermistor serving as a temperature detector contacts with the fixing roller.

In the case of the fixing apparatus, electrification from a commercial power supply to heating means is controlled so that the temperature detected by the thermistor reaches a temperature within a predetermined width from a target temperature and a heating temperature is adjusted.

Then, temperature control by the heating member in the continuous fixing step of a plurality of recording media in the fixing apparatus is described below by referring to FIG. 16. FIG. 16 is a graph showing transition of temperatures detected by a thermistor in the continuous fixing step of a plurality of recording media.

When an image forming apparatus having the above fixing apparatus starts an image forming process to a series of recording media constituted of N recording media, electrification from a commercial power supply to heating means is started and the temperature detected by the thermistor rises from a temperature a at the time of stop to temperature b and temperature c.

The electrification from the commercial power supply to the heating means is controlled so that the temperature detected by the thermistor is raised to a fixing temperature (heating temperature of recording medium) d immediately before the time T1 at which first recording medium enters the fixing nip portion. Then, the detected temperature is controlled so that it is maintained at a value within a predetermined width from the fixing temperature d from the period T1 to period T2 in which the recording medium is fixed.

Then, in the period before second recording medium is fixed after the first recording medium is fixed, the electrification from the commercial power supply to the heating means is controlled so that a temperature detected by the thermistor is maintained at a value within a predetermined width of the fixing temperature d or paper conveyance interval temperature e lower than the temperature d. By maintaining the temperature at the value within the predetermined width of the fixing temperature d or paper conveyance interval temperature e, it is possible to economize power consumption and prevent excessive temperature rise in a non-paper conveyance area at the outer periphery of a pressure roller.

The heating member is temperature-controlled as described above and heat is supplied from a heating member contacting with one side of a recording medium to heat the recording medium. Moreover, heat is also supplied from a pressure member contacting with the other side of the recording medium. Because the pressure member does not have heating means, the pressure member supplies the heat produced on the heating-member surface at a paper conveyance interval and accumulated to the recording medium under paper conveyance.

This control is disclosed in Japanese Patent Application Laid-Open Nos. S63-313182 and H06-149103.

However, the fixing apparatus controls the temperature of the heating member to a temperature equal to the fixing temperature d or the paper conveyance interval temperature e lower than the fixing temperature d.

The surface temperature of the pressure member is necessarily lowered compared to the temperature of the heating member surface heated at the fixing temperature d. Moreover, the temperature of the pressure member surface lowers by conveying heat quantity to the recording medium under paper conveyance.

As a result, the surface temperature of the pressure member considerably lowers compared to the temperature of the heating member surface and a large difference is produced in the heat quantity to be supplied to the surface of the recording medium when performing the heating and fixing operation at the fixing nip portion of the fixing apparatus.

When a recording medium is made of a material containing moisture such as paper, a difference is produced between moisture quantities evaporated from the front and back surfaces of the recording medium. Therefore, contraction and expansion values are changed at the front surface and back surface of the recording medium and there is a problem that warp and curl occur in the recording medium after fixed.

Particularly, when the environment in which an image forming apparatus or recording medium is put is a high-humidity environment and the recording medium contains much moisture and lacks in thickness and rigidity, curl becomes extreme.

When curl becomes extreme, it is impossible to systematically overlap or bind output recording media and the convenience of the output recording media is lost.

Moreover, when continuously outputting recording media, it is impossible to systematically mount the recording media on the discharge loading portion of an image forming apparatus and a problem occurs because output recording media are dropped and scattered or the discharge sequences are counterchanged. Furthermore, curled output recording media close the recording-medium discharge portion of the image forming apparatus, cause a bend or crease of a recording medium and stay to make an output of the image forming apparatus impossible.

SUMMARY OF THE INVENTION

Therefore, it is an object of the present invention to provide a heating apparatus capable of restraining the curl of an output member to be heated and an image forming apparatus having the heating apparatus as an image heating and fixing apparatus of a recording member and capable of restraining the curl of the output recording member.

A typical configuration of a heating apparatus of the present invention for achieving the above object has a heating member and a pressure member which are mutually pressure-welded and holds and conveys a member to be heated by a nip portion formed between the heating member and the pressure member and heat-treats the member. The heating apparatus is provided with a temperature detector for detecting the temperature of the heating member and power control means for controlling the detected temperature of the heating member to a target temperature, in which in a paper conveyance interval which is a period from end of heating the M-th member to be heated up to start of heating the M+1-th member to be heated in continuous heating of N members to be heated, the paper conveyance interval temperature which is a target temperature of a heating member set in the paper conveyance interval or in a certain period of the paper conveyance interval is set to a temperature higher than the heating temperature of the member to be heated which is a target temperature of the heating member at the time of heating the M+1-th member to be heated.

That is, by setting the target temperature of the heating member in the paper conveyance interval to a temperature higher than the target temperature at the time of heating the member to be heated, it is possible to raise the temperature of the pressure member in the paper conveyance interval, lower the temperature of the heating member at the time of heating the member to be heated, decrease the difference between the surface temperature of the heating member and the surface temperature of the pressure member at the time of heating the member to be heated, decrease the difference between the heat quantity supplied to the member to be heated from the heating member and the heat quantity conveyed to the member to be heated from the pressure member and restrain the warp and curl of the member to be heated.

Preferably, means for detecting the water content of a member to be heated is included to change the difference between paper conveyance interval temperature and heating temperature of the member to be heated.

Preferably, means for detecting at least either of the environmental temperature and environmental humidity set to a heating apparatus is included to change the difference between paper conveyance interval temperature and heating temperature of a member to be heated in accordance with at least either of the thickness and the type of the member to be heated.

Preferably, means for detecting at least either of the thickness and the type of a member to be heated is included to change the difference between paper conveyance interval temperature and heating temperature of the member to be heated in accordance with at least either of the thickness and the type of the member to be heated.

Preferably, the number of members to be heated continuously heated is counted to change the difference between paper conveyance interval temperature and heating temperature of the heating members.

Preferably, a heating member has fixed and supported heating means and a flexible member sliding on the heating means, in which a pressure member forms a nip portion with the heating means through a flexible member and holds and convey a member to be heated by the nip portion to heat the member to be heated by the heat of the heating means through the flexible member.

Preferably, a heating member is a heat roller.

Preferably, in a paper conveyance interval which is a period from end of heating the M-th member to be heated to start of heating the M+1-th member to be heated, the following modes are included: a first mode in which a paper conveyance interval temperature which is the target temperature of a heating member is set to a temperature higher than the heating temperature of a member to be heated which is the target temperature of a heating member at the time of heating the M+1-th member to be heated and a second mode in which the paper conveyance interval temperature is not set to a temperature higher than the heating temperature of the member to be heated which is the target temperature of the heating member at the time of heating the M+1-th member to be heated.

Preferably, in the first mode, a paper conveyance interval at the time of continuous printing is changed in accordance with any one of the environmental temperature and environmental humidity in which a heating apparatus is set and the thickness and the type of a member to be heated.

An image forming apparatus according to the present invention is provided with image forming means for making a recording material form and carry an unfixed image and image heating and fixing means for heating and fixing the unfixed image formed and carried by the recording material, in which the image heating and fixing apparatus is the above-described heating apparatus.

Another image forming apparatus according to the present invention is an image forming apparatus having a heating member and a pressure member which are mutually pressure-welded and a fixing apparatus for holding and conveying a recording material on which a toner image is formed by a nip portion formed between the heating member and the pressure member and heating and fixing the recording material, in which a temperature detector for detecting the temperature of a heating member and power control means for controlling the detected temperature of the heating member to a target temperature are included, the power control means has a curl reduction mode for reducing curl of a fixed recording material when continuously forming images on a plurality of recording materials and in the curl reduction mode, a period is set in which the target temperature of the heating member is set to a paper conveyance interval temperature higher than the target temperature of the recording material while fixed in a paper conveyance interval in which the recording material is not fixed.

Moreover preferably, means for detecting the water content of a member to be heated is included to change the difference between the paper conveyance interval temperature and the target temperature when fixing the recording material in accordance with the water content of the member to be heated.

Moreover preferably, means for detecting the environmental temperature or humidity in which a heating apparatus is set is included to change the difference between the paper conveyance interval temperature and the target temperature of a recording material in accordance with the environmental temperature or humidity.

Moreover preferably, means for detecting the thickness or type of a recording material is included to change the difference between the paper conveyance interval temperature and the target temperature of the recording material in accordance with the thickness or type of the recording material.

Preferably, the difference between the paper conveyance interval temperature and the target temperature of a recording material when fixed in accordance with the number of recording materials on which images are continuously formed.

Preferably, a heating member has a fixed and supported exothermic member and a flexible member sliding on the exothermic member, a pressure member forms a nip portion with the exothermic member through the flexible member and holds and conveys a recording material and heats and fixes a toner image formed on the recording material by the heat from the exothermic member through the flexible member.

Preferably, a heating member is a heat roller.

Preferably, in the curl reduction mode, the paper conveyance interval under continuous printing is changed in accordance with at least any one of the environmental temperature and humidity in which a heating apparatus is set and the thickness and type of a member to be heated.

More preferably, no-curl-reduction mode is included in which a period for setting the target temperature of a heating member is set to a paper conveyance interval temperature higher than the target temperature of a recording material when fixed in the period of a paper conveyance interval in which the recording material is not fixed.

Preferably, the paper conveyance interval at the time of continuous printing is larger in the curl reduction mode than in the no-curl reduction mode.

DESCRIPTION OF THE PREFERRED EMBODIMENTS

First Embodiment (1) An Example of an Image Forming Apparatus

Figure 1:
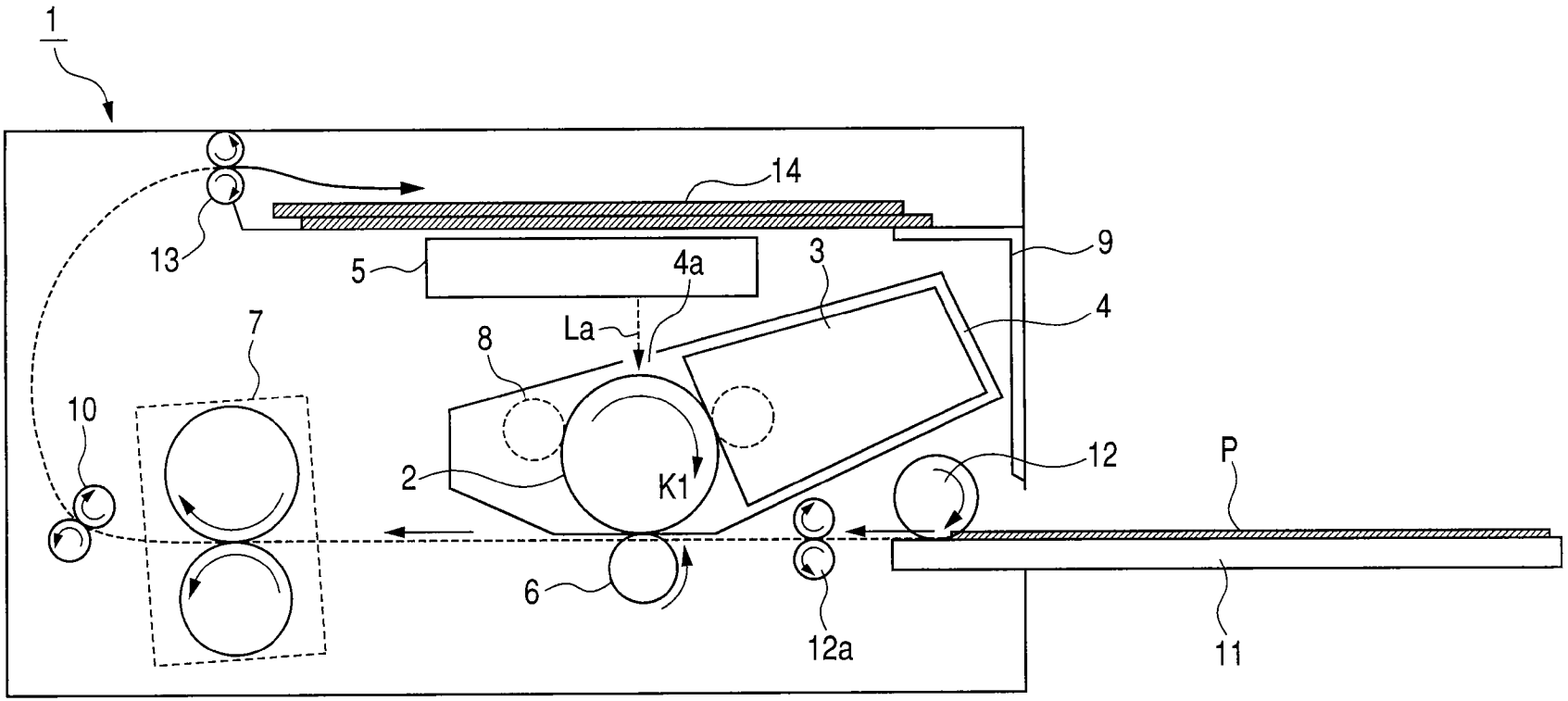
FIG. 1 is a schematic sectional view showing a schematic configuration of an image forming apparatus of embodiment 1.

FIG. 1 is a schematic sectional view showing a schematic configuration of a laser beam printer (hereafter-referred to as printer) 1 which is an example preferably showing the image forming apparatus of this embodiment.

The printer 1 is an image forming apparatus for performing a series of image forming processes of forming an image corresponding to the image information supplied from an external image-information providing apparatus (not illustrated) such as a host computer on a sheet-type recording medium P and recording the image in accordance with the widely-known electrophotographic system.

The printer 1 has a process cartridge 4 for holding a drum-type rotatable electrophotographic photosensitive member 2 serving as a latent image carrying body and a developing apparatus 3, a laser scanner unit (hereafter referred to as scanner) 5 for forming an electrostatic latent image by exposing the outer periphery of the photosensitive member 2 in accordance with image information, a roller-type rotatable transfer body 6 for transferring an image to a recording medium P and a fixing apparatus 7 for fixing the recording medium P to which an image is already transferred.

The process cartridge 4 set to the printer 1 holds, in addition to the photosensitive member and the developing apparatus, a primary charging mechanism 8 for charging the outer periphery of the photosensitive member 2 to a specified potential distribution before an exposing step by the scanner 5. Moreover, the process cartridge 4 is supported by the printer body so as to be removable from the printer body. When maintenance such as repair of the photosensitive member 2 or developer replenishment to the developing apparatus 3 is necessary, the maintenance is accelerated and simplified by opening a cover 9 supported by the body so that it can be opened or closed and then changing the whole process cartridge 4.

The primary charging mechanism 8 held by the process cartridge 4 charges the outer periphery of the photosensitive member 2 to a specified potential distribution when a specified bias is applied to the mechanism 8 from a commercial power supply before the exposing step by the scanner 5.

The scanner 5 set to the printer 1 scans and exposes the outer periphery of the charged photosensitive member 2 through a window 4*a* formed on the process cartridge body by a laser La modulated in accordance with a digital pixel signal generated in accordance with the image information supplied from the image-information providing apparatus. Thereby, an electrostatic latent image corresponding to the image information is formed on the outer periphery of the photosensitive member 2.

Then, a series of image forming processes in the printer 1 is described below. First, when start of a series of image forming processes is designated to the printer 1, the photosensitive member 2 starts rotation driving at a specified circumferential speed clockwise in the direction of the arrow K1 and the outer periphery of the photosensitive member 2 is charged to a specified potential distribution by the primary charging mechanism 8 to which a specified bias is applied.

Then, the charged portion on the outer periphery of the photosensitive member 2 is scanned and exposed by the scanner 5 in accordance with the image information supplied from the image-information providing apparatus and thereby, an electrostatic latent image corresponding to the image information is formed on the portion. The electrostatic latent image is visualized into an actual image by the developer of the developing apparatus 3.

Moreover, one recording medium P is separated from a sheet feed cassette 11 by a sheet feed roller 12 driven at a predetermined timing and conveyed. A plurality of recording media P are housed in the sheet feed cassette 11 and supported so that they can be removed by the printer body. The recording media P conveyed from the sheet feed cassette 11 are held and conveyed through a transfer nip portion formed between the photosensitive member 2 and the transfer body 6 at a predetermined timing of control by a resist roller pair 12*a*. In the holding and conveying process, the actual image at the photosensitive member-2 side is successively transferred to the recording medium-P side by the transfer body 6.

Then, the recording medium P to which the actual image is transferred is fixed by the fixing apparatus 7 and discharged to the outside from a printer sheet discharge portion 13 via a fixing sheet discharge portion 10 rotatably supported and loaded on a tray 14 of the printer body and a series of image forming processes is completed.

(2) Fixing Apparatus 7

Figure 2:
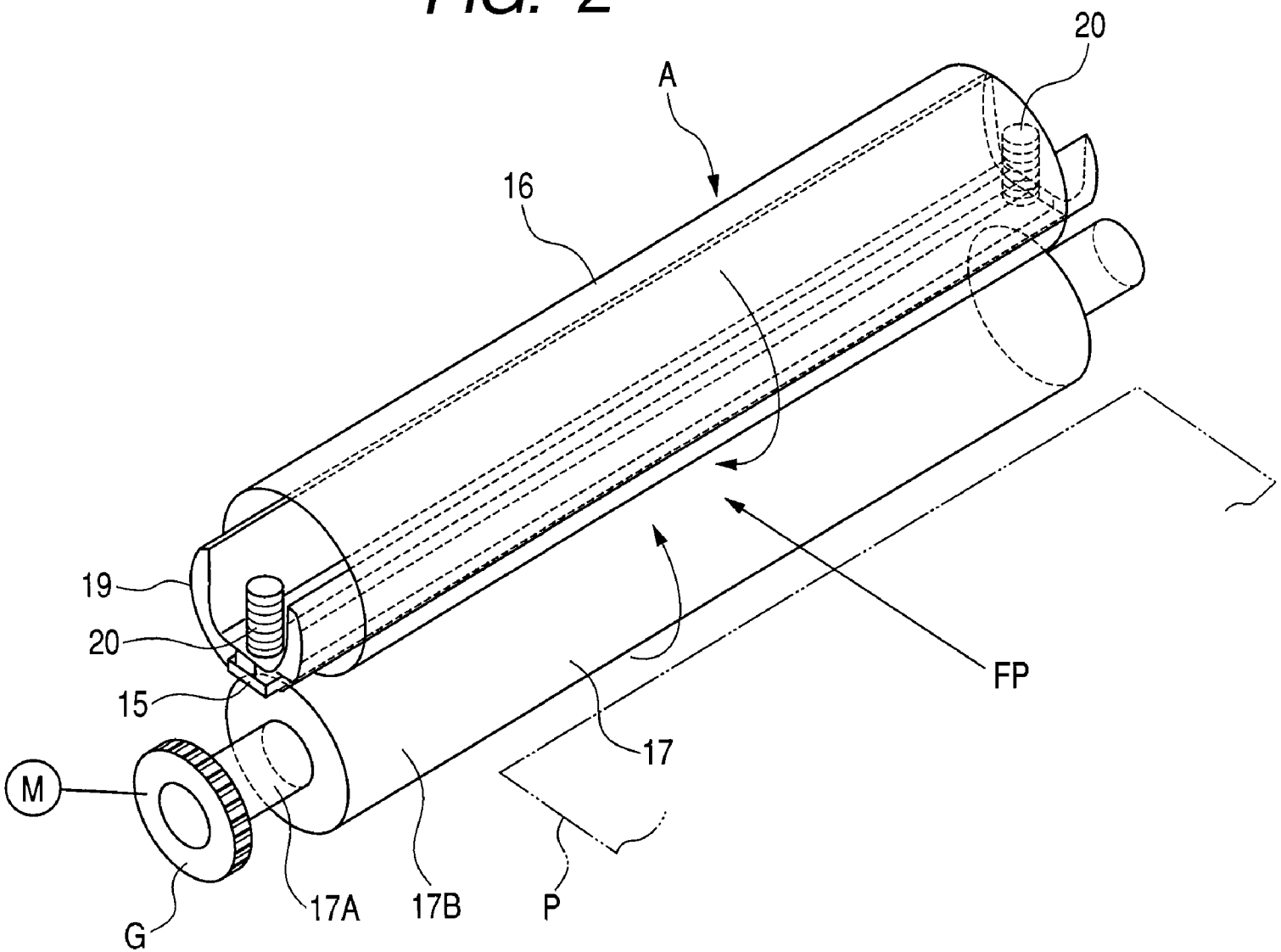
FIG. 2 is a perspective schematic view of an essential portion showing a schematic configuration of a fixing apparatus.
Figure 3:
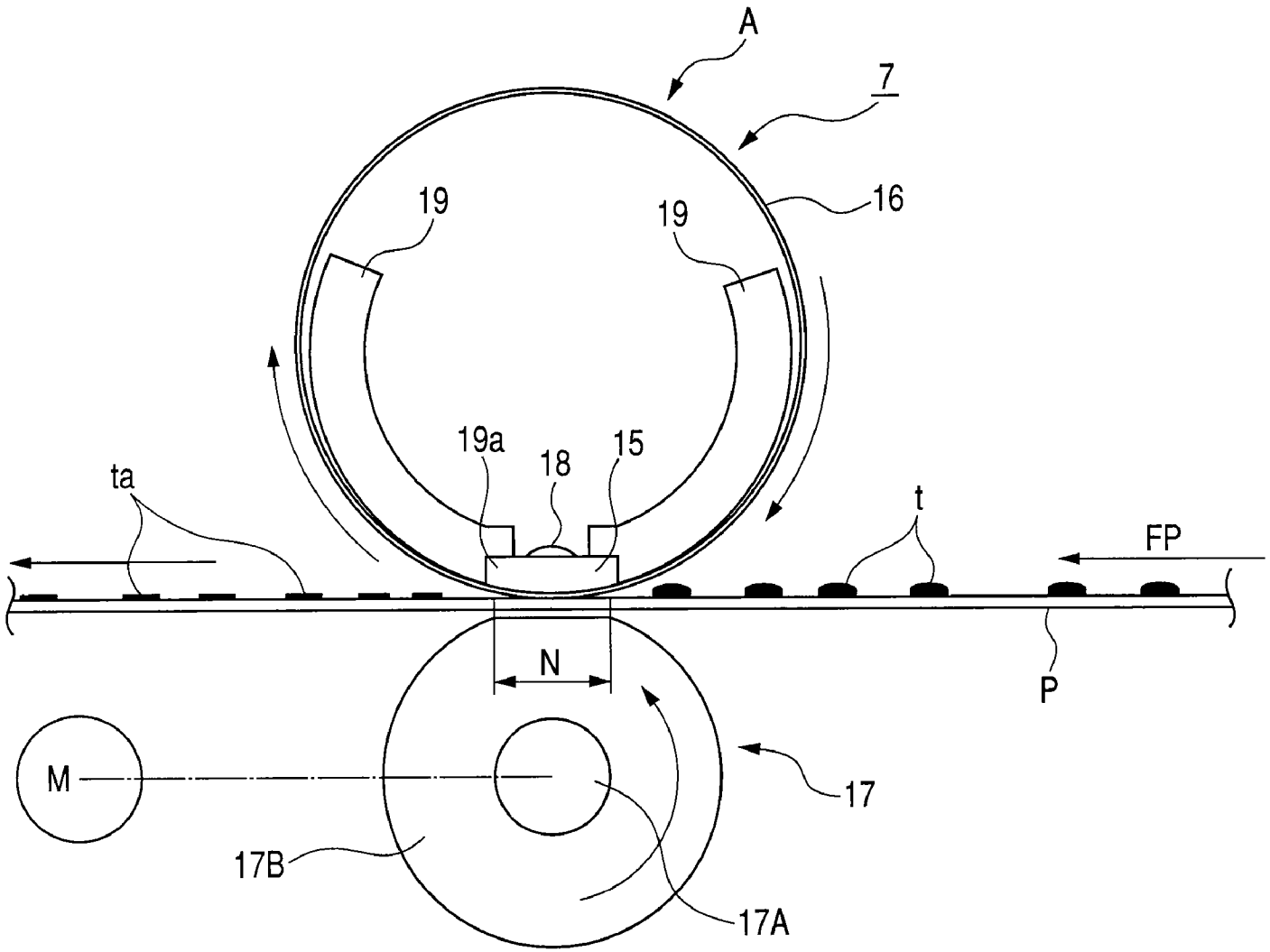
FIG. 3 is a schematic sectional view showing a schematic configuration of a fixing apparatus.

Then, the fixing apparatus 7 set to the printer 1 is described below. FIG. 2 is a perspective model diagram of an essential portion of the fixing apparatus 7 showing a schematic configuration of the fixing apparatus 7 and FIG. 3 is a schematic sectional view of the fixing apparatus 7. This fixing apparatus 7 is a film-heating-type pressure-member-driving-type heating apparatus.

Reference numeral 15 denotes a ceramic heater serving as heating means (heating source). As described later, the ceramic heater is landscape and has a small wall thickness and low heat capacity as a whole by using the direction intersecting a recording-medium conveying direction FP as a longitudinal direction on the conveying route surface of the recording medium P serving as a member to be heated. The ceramic heater produces heat by receiving power and quickly rises in temperature.

Reference numeral 19 denotes a heat-resistant heat-insulating heater holder. The heater holder 19 is a landscape rigidity member having a cross section of substantially semicircular-arc trough type using the direction intersecting the recording-medium conveying direction FP as the longitudinal direction. For example, the heater holder 19 is made of phenol thermosetting resin. The above ceramic heater 15 is fitted into a heater-fitting groove portion 19*a* formed along the longitudinal direction of the heater holder 19 at almost the central position of the downside of the holder 19.

Reference numeral 16 denotes a cylindrical or endless-belt-type flexible member. In the case of this embodiment, the flexible member 16 has a two-layer structure obtained by covering the outer periphery of an endless-belt-type member mainly containing polyimide with an endless-belt-type member mainly containing PTFE and the total layer thickness is 100 μm or less. The flexible member 16 is hereafter referred to as film. A configuration of the film 16 is not restricted to this embodiment. It is also allowed to use another effective structure for realizing a low heat capacity. For example, it is allowed to use a single layer structure of an endless-belt-type member mainly containing PTFE, PFA or FEP serving as a heat-resistant material or a two-layer structure obtained by covering the outer periphery of an endless-belt-type member mainly containing polyimide, polyamide imide, PEEK, PES or PPS with an endless-belt-type member mainly containing PTFE, PFA or FEP. Moreover, it is allowed to use a single layer structure using a metallic layer as the base or a compound layer structure. Furthermore, the total layer thickness of the film 16 is not restricted to this embodiment. To efficiently realize a low heat capacity, a total layer thickness of 100 μm or less is preferable and a total layer thickness ranging between 20 and 50 μm (both included) is more preferable.

The above cylindrical film 16 is loosely outer-fitted to the heater holder 19 to which the ceramic heater 15 is set. That is, the inner periphery length of the cylindrical film 16 is larger than the outer periphery length of the heater holder 19 by a predetermined value such as approx. 3 mm and thereby, is outer-fitted to the heater holder 19 with no tension.

A heating member A is constituted of the ceramic heater 15, heater holder 19 and film 16.

Reference numeral 17 denotes a pressure roller serving as a pressure member. The pressure roller 17 is an elastic roller constituted of a cylindrical or almost-cylindrical cored bar 17A made of a metal such as aluminum and an elastic layer 17B mainly containing silicone rubber having a high mold release characteristic covering the outer periphery of the cored bar 17A.

In the case of the pressure roller 17, both ends of the cored bar 17A are rotatably bearing-supported between not-illustrated apparatus-side plates. The above heating member A is set on the upside of the pressure roller 17 in parallel by turning the ceramic heater-15 side downward and both ends of the heater holder 19 are pressed to the pressure roller-17 side at a predetermined pressure by energizing springs 20 and 20 against the elasticity of the elastic layer 17B. Thereby, a member-attached nip portion N serving as a pressure-welded nip portion having a predetermined width is formed in accordance with elastic deformation of the elastic layer 17B of the pressure roller by pressure-welding the ceramic heater 15 and the pressure roller 17 at both sides of the film 16.

In the case of the pressure roller 17, the driving force of a driving mechanism M is transferred to a drive gear G set to an end of the cored bar of the pressure roller and rotation-driven counterclockwise in the direction of the arrow in FIG. 3. A torque works on the film 16 in accordance with the friction force between the pressure roller 17 and the outer face of the film 16 at the fixing nip portion N. Therefore, the inside of the film 16 driven-rotates at the outside of the heater holder 19 at a circumferential speed almost corresponding to the circumferential speed of the pressure roller 17 clockwise in the direction of the arrow while closely contacting with and sliding on the downside of the ceramic heater 15 at the fixing nip portion N. The heater holder 19 also serves as the guide member of the driven-rotating film 16.

Moreover, when the film 16 is rotated by the pressure roller 17 and the ceramic heater 15 is raised to a predetermined temperature, the recording medium P forming and carrying an unfixed toner image t is introduced between the fixing nip portion 16 and the pressure roller 17 from an image forming portion side. Then, the recording medium P closely contacts with the outer face of the film 16 and passes through the fixing nip portion N while overlapping with the film 16.

In the passing process of the fixing nip portion, heat energy of the ceramic heater 15 is supplied to the recording medium P through the film 16 and the unfixed toner image t on the recording medium P is heated, melted and fixed. The recording medium P passes through the fixing nip portion N and is separated from the face of the film 16 and discharged. Reference character tb denotes a fixed toner image on the recording medium P.

Because the film 16 closely contacts with and slides on the ceramic heater 15, grease is applied in the film 16 in order to prevent abrasion or reduce the sliding resistance.

(3) Ceramic Heater 15

Figure 4A:
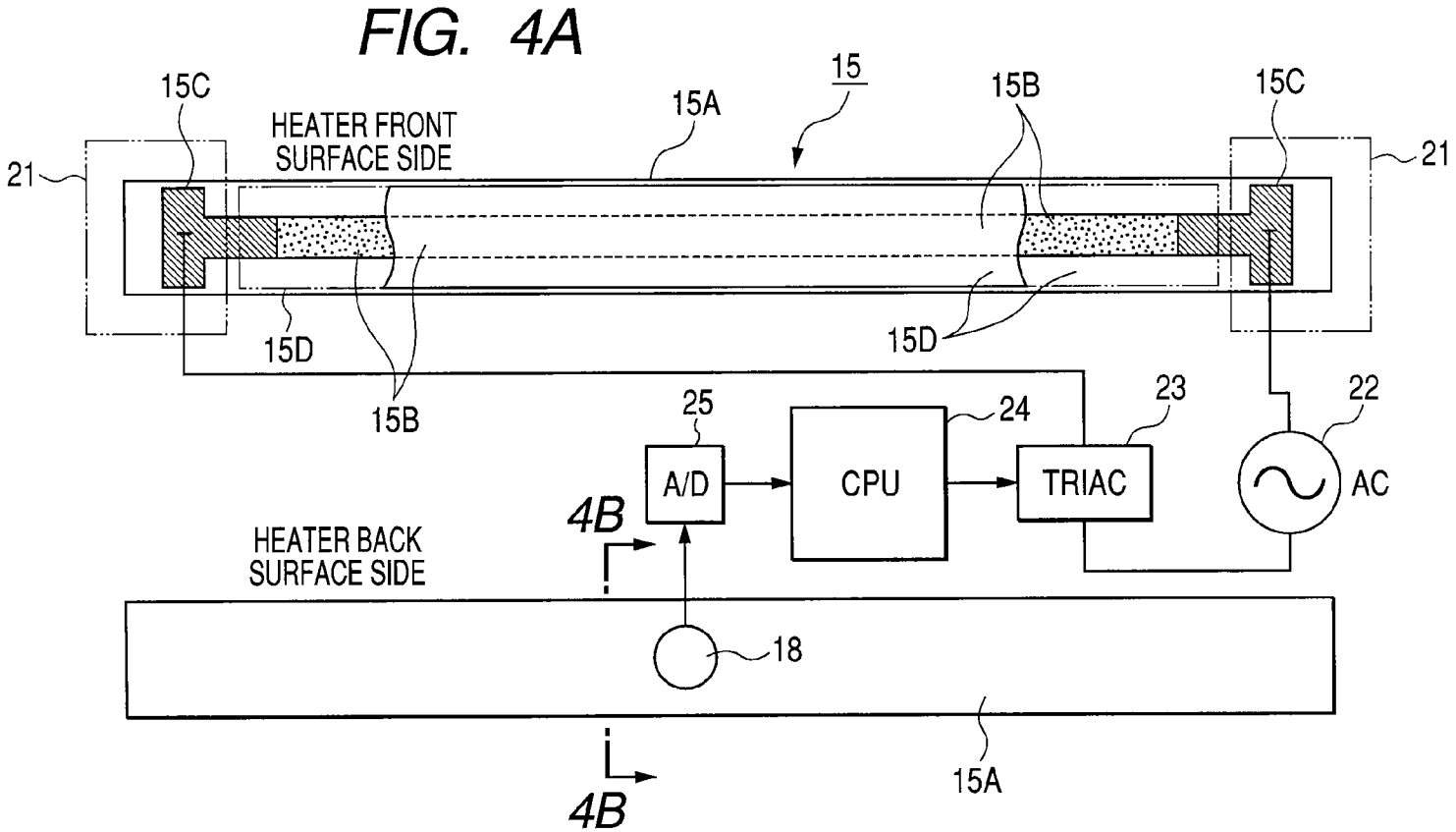
FIG. 4A is a schematic view of an example of a ceramic heater.
Figure 4B:
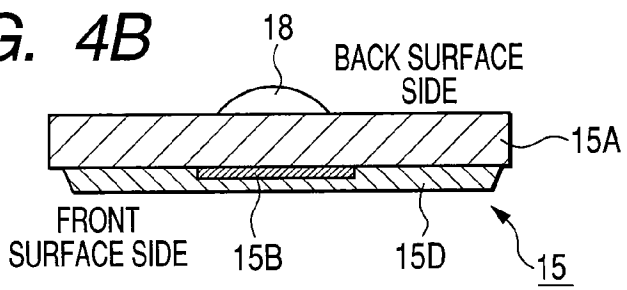
FIG. 4B is an illustration showing an enlarged cross-sectional view taken along the line 4B-4B in FIG. 4A.

FIG. 4A is a schematic block diagram of the ceramic heater 15 serving as heating means, which shows the front surface side and the back surface side of a heater. Moreover, FIG. 4B shows an enlarged sectional view taken along the line 4A-4A in FIG. 4A. The ceramic heater 15 includes:

1) a landscape ceramic substrate (insulating substrate) 15A made of high-insulation ceramic such as alumina, aluminum nitride or silicon carbide, using the direction orthogonal to the recording-medium conveying direction FP on the conveying route of the recording medium P as the longitudinal direction, 2) an exothermic resistor 15B made of Ag/Pd (silver palladium), $RuO_2$ or $Ta_2N$, for example formed by forming it like a linear or zonal shape having a thickness of approx. 10 μm and a width of approx. 1 to 5 mm by screen printing on the surface of the ceramic substrate 15A along the longitudinal direction of it, 3) electrode portions 15C formed by electrically connecting it to the both ends of the exothermic resistor 15B in the longitudinal direction and made of Ag/Pt (silver platinum), 4) an insulating protective layer 15D formed of thin glass coat or fluorine resin coat electrically insulated and capable of withstanding the friction with the film 16 provided on the surface of the exothermic resistor 15B, and 5) a thermistor 18 serving as a temperature detector set at the back surface of the ceramic substrate 15A.

In the case of the above ceramic heater 15, the side on which the insulating protective layer 15D is formed is the front surface and the film 16 slides on the face of the insulating protective layer 15D. The ceramic heater 15 is fitted into the heater-fitting groove portion 19*a* (FIG. 3) formed on the downside of the heater holder 19 along the longitudinal direction of it by turning the front surface side of the heater to the outside and adhered by a heat-resistant adhesive.

Reference numerals 21 and 21 respectively denote a feeding connector, which are fitted to electrode portions 15C of the ceramic heater 15 and electric contacts of the feeding connectors contact with the electrode portions 15C. Reference numeral 22 denotes a commercial power supply (AC), 23 denotes a TRIAC and 24 denotes power (electrification) control means (CPU). The ceramic heater 15 quickly and steeply rises in temperature by the heat of the exothermic resistor 15B because power is supplied between the electrode portions 15C and 15C through the TRIAC 23 from the commercial power supply 22.

The temperature rise of the ceramic heater 15 is detected by the thermistor 18 serving as a temperature detector and the electric analog information on the detected temperature is input to an analog-digital conversion circuit (A/D conversion circuit) 25, digitized and input to the power control means 24.

The power control means 24 to which digital information corresponding to the temperature detected by the thermistor 18 controls the electrification from the commercial power supply 22 to the exothermic resistor 15B so that the temperature detected by the thermistor 18 becomes a value within a predetermined width from a target temperature.

In the case of this embodiments control of an electrification phase (phase control) every half cycle of the commercial power supply 22 or switching of electrification to either of connection and disconnection (frequency control) is used as the electrification control to the exothermic resistor 15B from the commercial power supply 22 by the power control means 24 according to the temperature detected by the thermistor 18.

(4) Curl Reduction Mode

In the case of the fixing apparatus 7, when performing heating and fixing while holding and conveying the recording medium P by the fixing nip portion N at the time of heating and fixing, the ceramic heater 15 contacting with the front surface of the recording medium P through the film 16 at the heating member-A side produces heat. However, the pressure roller 17 serving as a pressure member contacting with the back surface of the recording medium P does not have an exothermic source. Therefore, when performing the heating and fixing operation at the fixing nip portion N of the fixing apparatus 7, a large difference is produced between heat quantities to be supplied to the front and back surfaces of the recording medium P.

When the recording medium P is made of a material containing moisture such as paper, a difference is produced between moisture quantities evaporated from the front and back surfaces of the recording medium P. Therefore, because contraction and expansion values are changed on the front surface and the back surface of the recording medium P, there is a problem that curl (warp of paper) occurs on the recording medium P after fixed.

When using a configuration of setting a second heat source to the pressure roller-17 side and heating a pressure roller by the second heat source, it is possible to set the front surface temperature of the pressure roller and control a temperature difference between the front and back surfaces of the fixing nip portion N. However, a fixing apparatus becomes complex and expensive.

Therefore, in the case of this embodiment, as the curl reduction mode, the target temperature of the heating member A in the paper conveyance interval up to start of fixing to the N+1-th recording medium after fixing to the N-th recording medium is completed is set to a temperature higher than the target temperature of the heating member A in the fixing period of a recording medium.

In this case, in the case of the heating apparatus according to the film heating system, the temperature of the heating member A is substantially equal to the temperature of the ceramic heater 15 serving as heating means.

Figure 5:
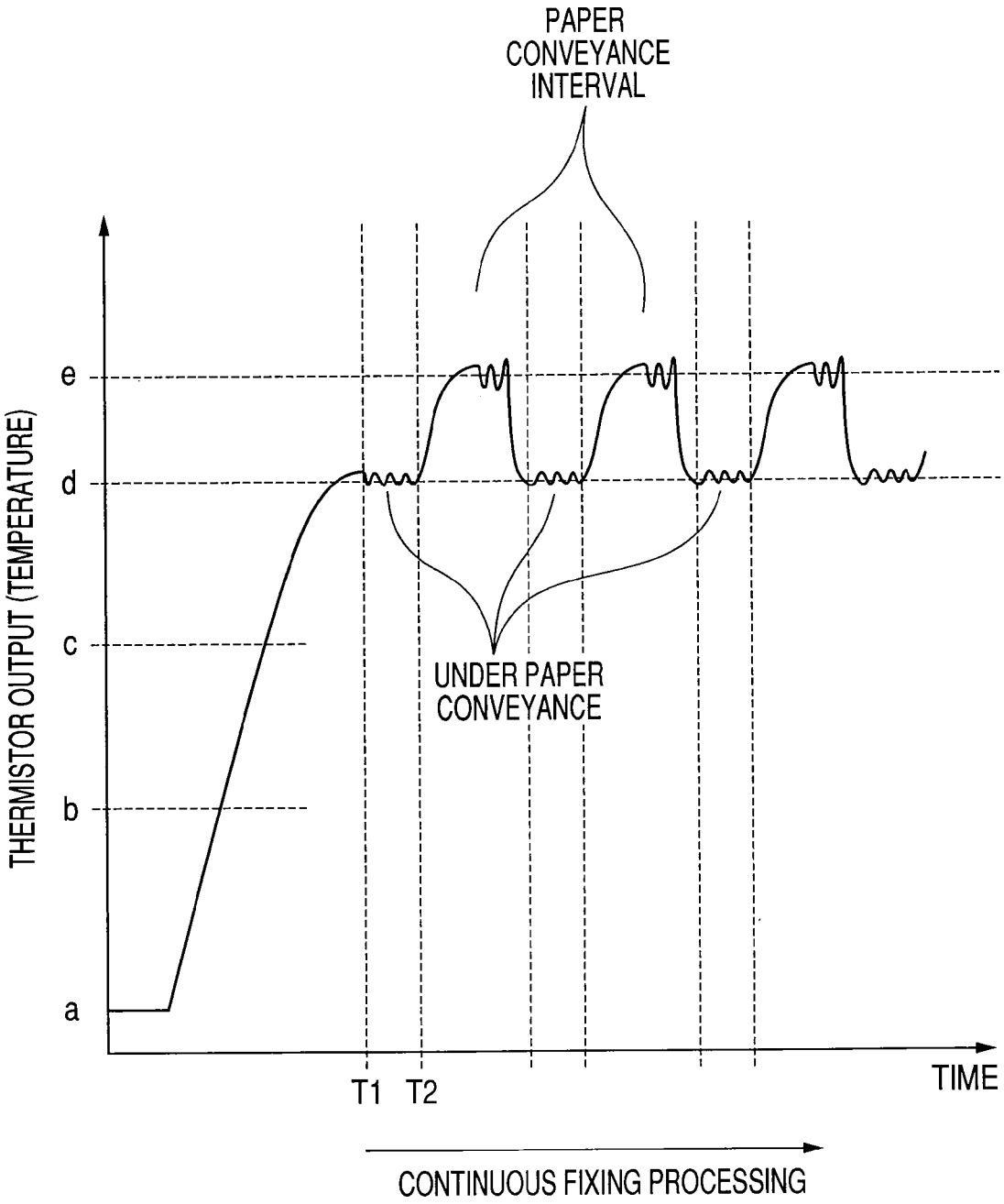
FIG. 5 is an illustration showing a transition of thermistor detection temperatures in a continuous fixing step.

The temperature control of the ceramic heater 15 in the continuous processing step for a plurality of recording media in this embodiment (that is, temperature control of the heating member A) is described by referring to FIG. 5. The following temperature control is performed by the power control means 24 in accordance with a temperature detected by the thermistor 18.

When starting a series of image forming processes to a recording medium, rotation of the pressure roller 17 is started and electrification from the commercial power supply 22 to the ceramic heater 15 at the heating member-A side is started. Thereby, a temperature detected by the thermistor 18 is raised from temperature a to temperature b and temperature c and the pressure roller 17 serving as a pressure member is heated by the heat of the ceramic heater 15 through the film 16 at the heating member-A side.

By the time T1 when one recording medium carrying an unfixed image enters the fixing nip portion N, a temperature detected by the thermistor 18 (that is, temperature of the heating member A) is raised to the fixing temperature d. Moreover, the TRIAC 23 is controlled by the power control means 24 and electrification from the commercial power supply 22 to the exothermic resistor 15B is controlled so that the detected temperature is maintained at a value within a predetermined width from the fixing temperature d between the time T1 and time T2 in which fixing is applied to the recording medium.

Then, in the period from the time when fixing the first recording medium is completed to the time when fixing the second recording medium is started, the TRIAC 23 is controlled and electrification from the commercial power supply 22 to the exothermic resistor 15B is controlled in order to maintain a temperature detected by the thermistor 18 at a value within a predetermined width from the paper conveyance interval temperature e. The temperature e which is the paper conveyance interval temperature is set to a temperature higher than the fixing temperature d.

Hereafter, the power control means 24 switches the target temperature to the paper conveyance interval temperature e after fixing the N-th recording medium and switches the target temperature to the fixing temperature d before fixing the N+1-th recording medium is started so that the temperature detected by the thermistor returns to a value within a predetermined width from the fixing temperature d when fixing the N+1-th recording medium is started.

Then, advantages of this embodiment are described below. First, the experiment 1 was performed to confirm how the fixing temperature d, paper conveyance interval temperature e and paper conveyance interval length influence the curled value and loading characteristic of a fixed recording medium.

[First Experiment]

The curled value and loading characteristic of the fixed recording medium was evaluated by fixing the fixing temperature d, changing the difference between fixing temperature d and paper conveyance interval temperature e to 0° C., 5° C., 10° C. and 15° C. and changing a paper conveyance interval length to 0.5 sec. 1 sec, 2 sec, 3 sec and 5 sec.

Because time is required until a ceramic heater temperature reaches a target temperature after controlling electrification to the ceramic heater 15, an experiment for increasing the difference between fixing temperature d and the paper conveyance interval temperature e is not performed when a paper conveyance interval is short. The recording medium used for a paper conveyance experiment used Xerox4024 paper which was left as it was for approx. 3 days under conditions of weighting capacity of 75 g/m$^2$, air temperature of 30° C. and humidity of 80% and the water content of the paper was approx. 10%.

The specific configuration of a fixing apparatus used for this experiment is shown below. In a fixing apparatus 7 constituted as shown in FIGS. 2 to 4, an elastic layer 17B made of foamed rubber having a thickness of 4 mm was formed on an aluminum cored bar 17A to form a pressure roller 17 having an outside diameter of 25 mm. The pressure roller 17 and a ceramic heater 15 were pressure-welded to the outer periphery of a basic layer made of polyimide resin of 60 μm at 96 N (9.8 kg) through an endless zonal film 16 having a surface layer made of PFA of 10 μm.

In the case of this experiment, an image forming apparatus using the above fixing apparatus was used. The conveying speed of a recording medium P was set to 111 mm/sec at which an LTR-size recording material could be conveyed at a throughput of 20 PPM and the fixing temperature (fixing temperature d) while the recording medium passed through a fixing nip portion was set to 180° C.

The image forming apparatus used for this experiment has a configuration same as that in FIG. 1 and a recording medium fixed and discharged from the fixing apparatus 7 is output to and loaded on a sheet discharge tray 14. A printer sheet-discharge portion 13 constituted of a sheet discharge roller and sheet discharge cylinder is located at a position 40 mm above the face of the sheet discharge tray 14. When a smooth sheet having a weighting capacity of 75 g/m2 having no curl is used, it is possible to load approx. 300 discharge sheets.

By using the above image forming apparatus, 100 sheets were continuously fixed under conditions of air temperature of 30° C. and humidity of 80%.

Figure 6:
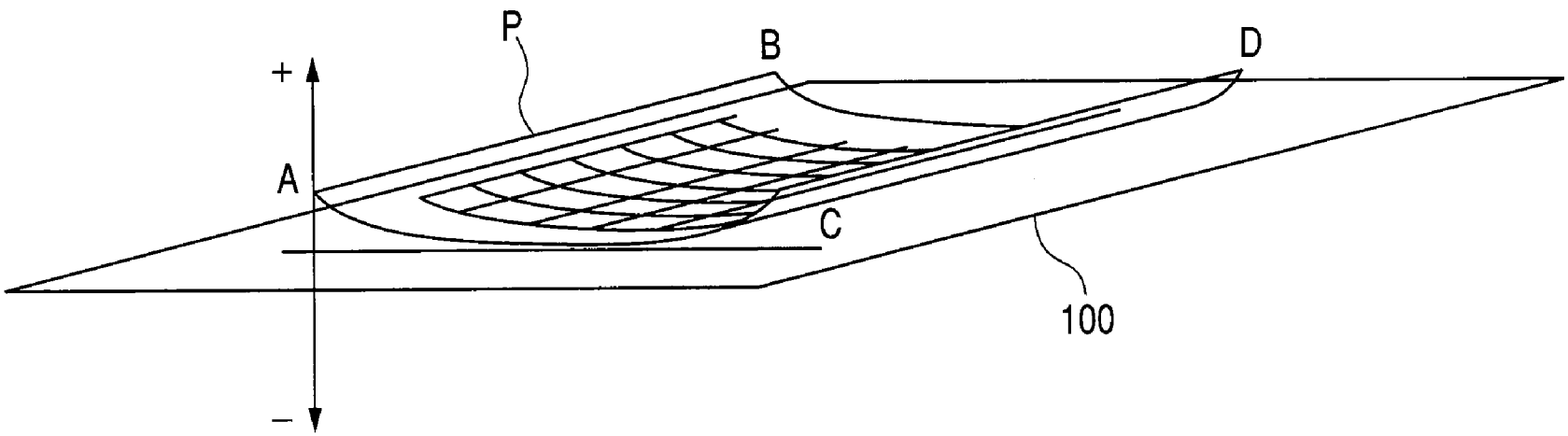
FIG. 6 is a schematic view showing a method for measuring curl of a recording medium in experiment 1 in the embodiment 1.

As shown in FIG. 6, for curled value measurement, the fixed recording medium P is put on a horizontal table 100 to measure the distance of the recording medium P from the square table. Thirty recording media are extracted from the top of the loaded recording media and the average value of values of four corners of a bundle of arranged 30 recording media is shown.

For the loading characteristic evaluation, a case in which recording media loaded on the sheet discharge tray 14 are protruded from the area of the sheet discharge tray 14 having widths of 316 mm and 386 mm larger than the size of the recording medium by a length of 10 cm and a breadth of 10 cm is shown as mis-alignment. Moreover, recording media further disordered and dropped from the sheet discharge tray 14, those protruded from the area of the sheet discharge tray 14 by 20 cm or more and those occluding the sheet discharge portion of a fixing apparatus due to the curl of a recording medium and causing creases or corner breakage are shown as NG.

Table 1 shows result of performing the experiment under the above conditions.

TABLE 1

| Paper conveyance interval temperature – Fixing temperature (° C.) | Paper conveyance interval length (sec.) 0.5 | 1.5 | 3.0 | 6.0 | 12 | 15 |
|---|---|---|---|---|---|---|
| 0 Curl (mm) | 47 | 46 | 33 | 27 | 25 | 24 |
| Loading characteristic | NG | NG | NG | misalignment | misalignment | misalignment |
| 5 Curl (mm) | | 40 | 31 | 26 | 24 | 21 |
| Loading characteristic | | NG | misalignment | misalignment | misalignment | misalignment |
| 10 Curl (mm) | | 35 | 29 | 23 | 16 | |
| Loading characteristic | | misalignment | misalignment | misalignment | GOOD | |
| 15 Curl (mm) | | | 23 | 17 | | |
| Loading characteristic | | | misalignment | GOOD | | |
| 20 Curl (mm) | | | 15 | | | |
| Loading characteristic | | | GOOD | | | |

In the case of experiment results in which the fixing temperature d and paper conveyance interval temperature e are made equal and the paper conveyance interval length is 3.0 sec or less, the curl of fixed sheet is large and output sheets are bulky, sheets are dropped from a sheet discharge tray while 100 sheets are continuously fixed.

When the fixing temperature d is higher than the paper conveyance interval temperature e and the difference between the temperatures d and e is increased, a curled value decreases and loading characteristic is improved.

Moreover, when increasing a paper conveyance interval length, the curled value decreases and the loading characteristic is improved.

However, it was impossible to load 100 sheets in which the fixing temperature d is equal to the paper conveyance interval temperature e even if increasing the paper conveyance interval length.

Figure 7:
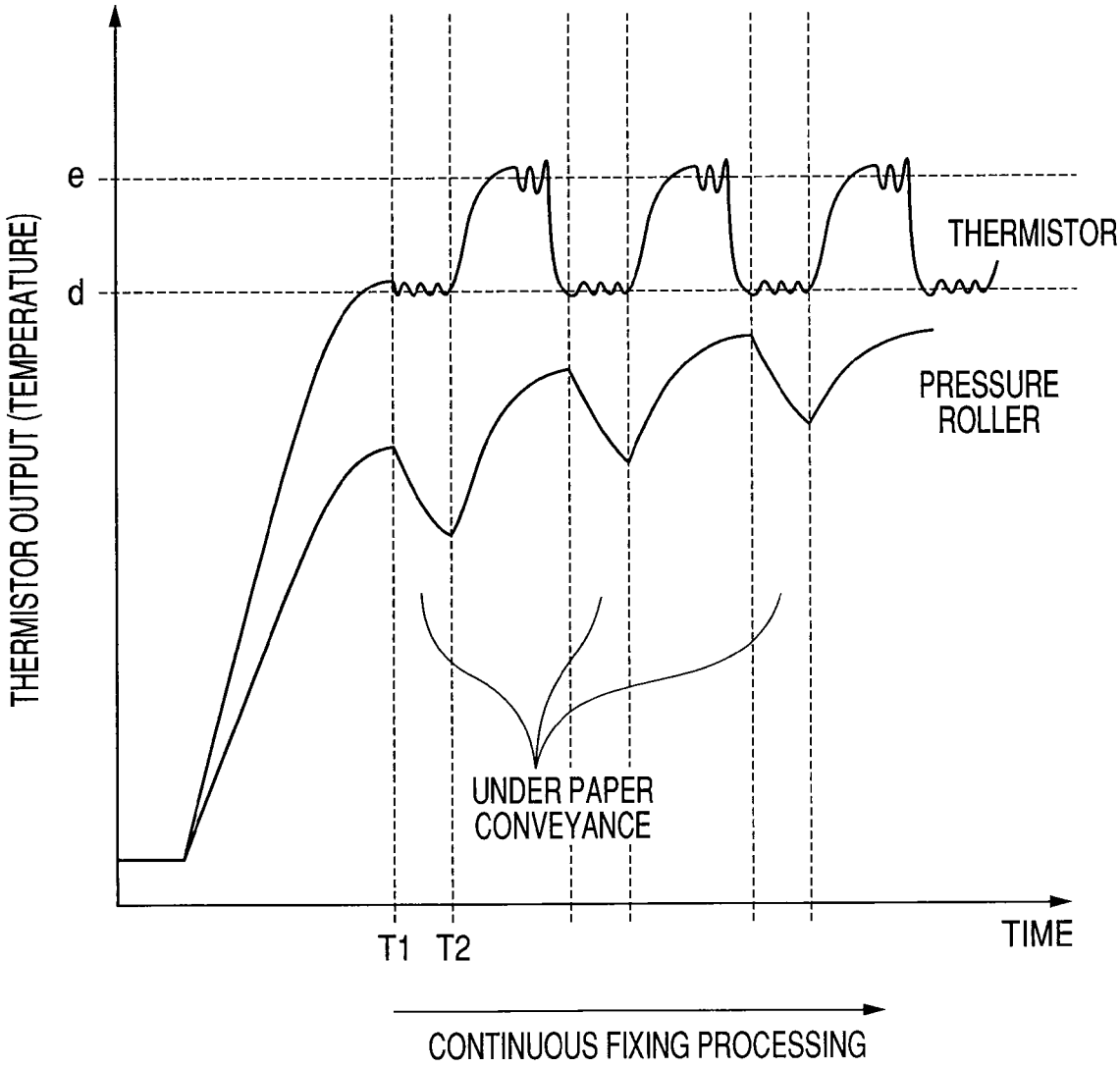
FIG. 7 is an illustration showing a transition of thermistor detection temperature and pressure-roller surface temperature in a continuous fixing step in the embodiment 1.

To describe results of the above experiment, FIG. 7 shows results of measuring the surface temperature of the pressure roller 17 in continuous fixing in the above experiment.

The temperature of the pressure roller 17 during continuous fixing is raised in a paper conveyance interval because the roller 17 is warmed by the ceramic heater 15 through the film 16 and its heat is robbed by the recording medium P. Therefore, the temperature is lowered during fixing and changed while it rises and lowers.

Table 2 shows the highest temperature of the pressure roller 17 while 100 sheets are fixed and the difference between the fixing temperature d and the pressure roller temperature at that time. Because the fixing temperature d is a target temperature for controlling the surface of a heater, it is different from the temperature of the film surface. Therefore, the difference is different from the actual temperature difference in the fixing nip portion N. However, the difference is shown because it serves as a reference for the difference between heat quantities to be supplied to the front and back surfaces of the recording medium P.

TABLE 2

| Paper conveyance interval temperature – Fixing temperature (° C.) | Paper conveyance interval length (sec.) 0.5 20 ppm | 1.5 14 ppm | 3.0 10 ppm | 6.0 8 ppm | 12 6 ppm | 15 4 ppm |
|---|---|---|---|---|---|---|
| 0 Pressure roller temperature (° C.) | 110 | 140 | 150 | 155 | 160 | 160 |
| Fixing temperature – Pressure roller temperature (° C.) | −70 | −40 | −30 | −25 | −20 | −20 |
| 5 Pressure roller temperature (° C.) | | 145 | 155 | 160 | 165 | 165 |
| Fixing temperature – Pressure roller temperature (° C.) | | −35 | −25 | −20 | −10 | −15 |
| 10 Pressure roller temperature (° C.) | | 150 | 160 | 165 | 170 | |
| Fixing temperature – Pressure roller temperature (° C.) | | −30 | −20 | −15 | −10 | |
| 15 Pressure roller temperature (° C.) | | | 165 | 170 | | |
| Fixing temperature – Pressure roller temperature (° C.) | | | −15 | −10 | | |
| 20 Pressure roller temperature (° C.) | | | 170 | | | |
| Fixing temperature – Pressure roller temperature (° C.) | | | −10 | | | |

In the case of the experiment in which the fixing temperature d is equal to the paper conveyance interval temperature e and the length of a paper conveyance interval is set to 0.5 sec, the pressure roller temperature is low. It is estimated that the pressure roller is not sufficiently heated in the paper conveyance interval. From this result, it can be described that curl was large because the difference between the temperature of the ceramic heater 15 and the temperature of the pressure roller was large at the time of heating and fixing and the difference between heat quantities to be supplied to the front and back surfaces of a sheet was large.

When increasing a paper conveyance interval while keeping the fixing temperature d equal to the paper conveyance interval temperature e, the temperature of the pressure roller 17 rose. However, even if increasing the power conveyance interval length to a certain value or more, the pressure roller temperature was almost saturated at a constant temperature difference from the fixing temperature d.

The temperature of the pressure roller 17 is saturated at a temperature lower than the temperature of the heated ceramic heater 15 in accordance with a heat resistance or heat capacity to the film 16 present between the ceramic heater 15 and the pressure roller 17 and other peripheral components. As a result of the previous experiment and temperature measurement, it is found that it is impossible to decrease the difference between heat quantities to be supplied to the front and back surfaces of a sheet during fixing so as to completely correct curl.

Only by setting a target temperature in a paper conveyance interval to the fixing temperature d, heating the pressure roller 17 and increasing the paper conveyance interval, it is found that it is impossible to make the temperature difference of the ceramic heater 15 during fixing smaller than the loss of heat energy due to the heat resistance or heat capacity to the film 16 and other peripheral components.

In the case of the experiment result in which the paper conveyance interval temperature e is raised to a temperature higher than the fixing temperature d in a paper conveyance interval to heat the pressure roller 17 and at the time of fixing, the fixing temperature d is lowered to a temperature lower than the paper conveyance interval temperature e, it is possible to decrease the difference between pressure roller temperature and the ceramic heater temperature at the time of fixing. The result of the previous experiment can be described as the fact that it is possible to decrease the difference between heat quantities to be supplied to the front and back surfaces of a sheet during fixing so as to sufficiently correct curl.

As described above, it is found that a method for setting the paper conveyance interval temperature e to a temperature higher than the fixing temperature d is superior to a method for setting the paper conveyance interval temperature e to a temperature equal to or lower than the fixing temperature d in decrease of curl and loading characteristic of the fixed recording medium P.

That is, by executing the curl reduction mode in Table 3, even if using a recording medium having a large water content, it is possible to use the recording medium output at a high quality with no stress without performing extra operations such as correction of strain of or alignment of a recording medium by a user. In the case of curl reduction mode, the paper conveyance interval temperature e is set to a temperature higher than the fixing temperature d by 20° C. Because the difference between the paper conveyance interval temperature e and the fixing temperature d is large and a lot of time is required for switching of temperatures, the paper conveyance interval length is set to 3.0 sec. Being effective for curl and loading characteristic is shown in Table 1.

Moreover, the throughput priority mode is used in addition to the curl reduction mode in Table 3 so that a user not minding curl, environment in which no curl occurs, user using a sheet or user giving priority to throughput can automatically or manually and quickly select the throughput priority mode. Thereby, it is possible to quickly obtain an output image according to necessity.

Figure 8:
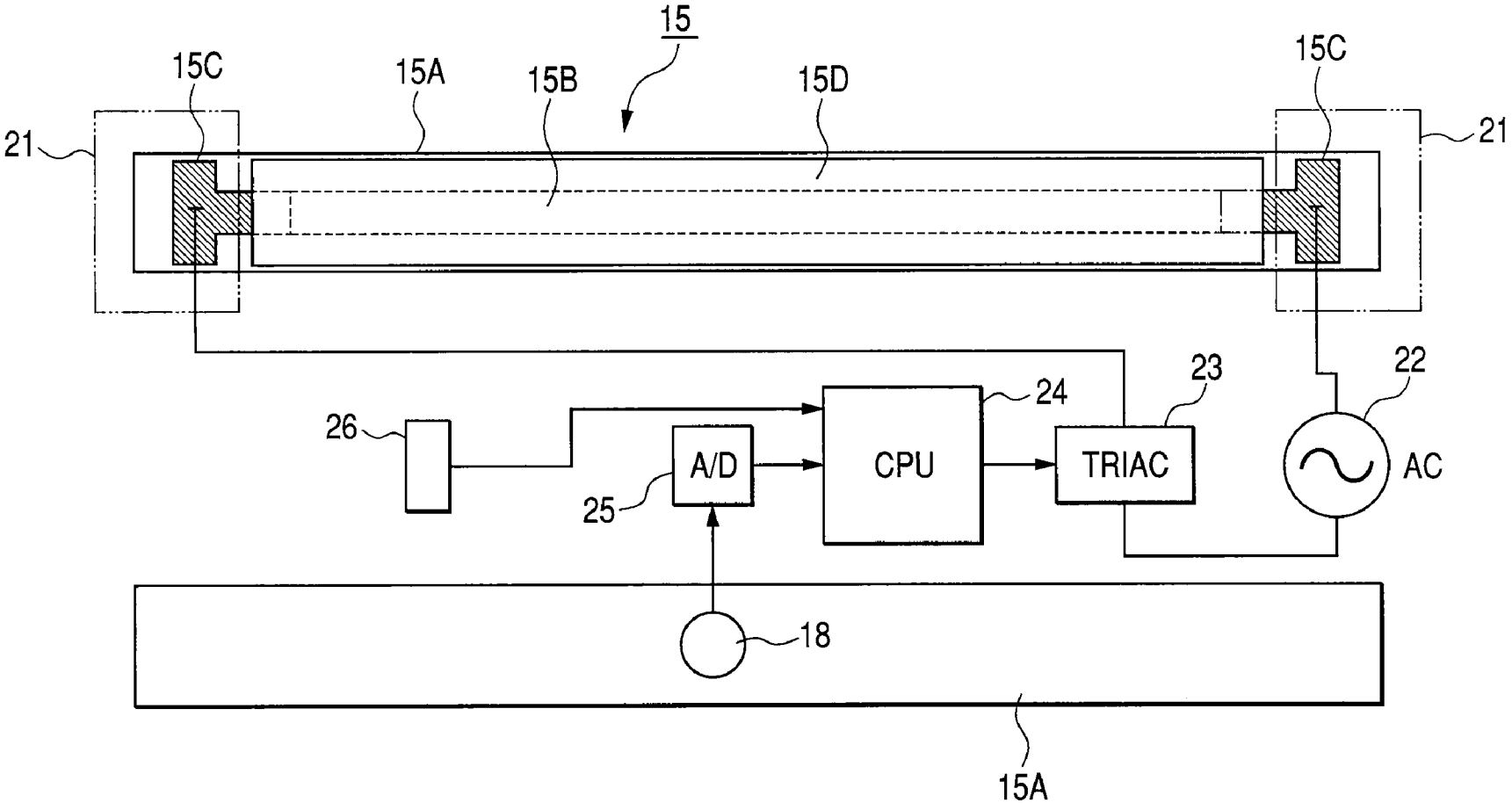
FIG. 8 is a block diagram of a heater temperature control system including selection means of curl reduction mode and throughput priority mode.

In FIG. 8, reference numeral 26 denotes mode selection means for selecting the cur prevention mode and throughput priority mode. The power control means 24 controls the temperature of the ceramic heater 15 in accordance with the curl reduction mode or throughput priority mode selected by the selection means 26.

TABLE 3

| Fixing mode | Paper conveyance interval length (sec.) | Paper conveyance interval temperature – Fixing temperature (° C.) |
|---|---|---|
| Throughput priority mode | 0.5 | 0 |
| Curl reduction mode | 3.0 | 20 |

In the throughput priority mode, priority is given to throughput compared to the case of the curl reduction mode to decrease a paper conveyance interval. The paper conveyance interval length in the throughput priority mode is set to a time as short as possible as long as an apparatus other than a sheet feeding apparatus for feeding a recording medium to an image forming apparatus or unfixed image forming apparatus allows. For example, the paper conveyance-interval length is set to 0.5 sec.

To set a paper conveyance interval as short as possible, fixing temperature is made equal to paper conveyance interval temperature and switching of temperatures in a paper conveyance interval which requires a lot of time is not performed every time. However, when continuously fixing a lot of sheets, switching of temperatures is performed at a predetermined number of sheets Z.

For example, paper conveyance interval temperature and fixing temperature are switched from h1 to h2 at timing Td when fixing the Z-th sheet is completed to control the temperatures to a temperature 5° lower than the temperature before the timing Td.

When continuously performing fixing even in a fixing mode in which a paper conveyance interval is short, temperatures of a pressure roller and the whole fixing apparatus slowly rise and excessive heat quantity is supplied to the recording medium P. When supplying excessive heat quantity to a developer on a recording medium, the developer is excessively dissolved, its viscosity is extremely lowered and the developer is transferred to the film 16 to cause an image trouble.

Figure 9:
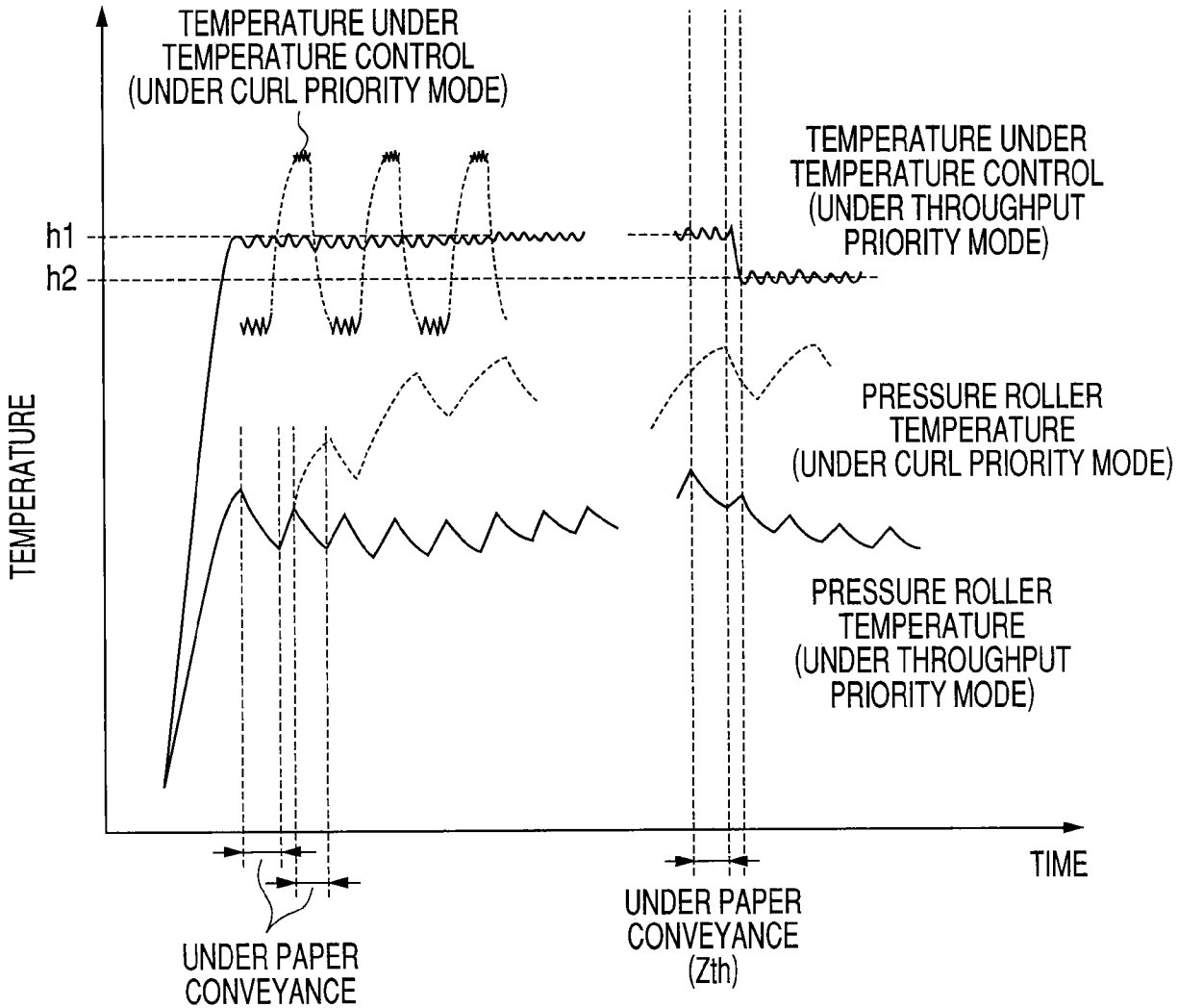
FIG. 9 is an illustration showing a transition of thermistor detection temperature and pressure-roller surface temperature in a continuous fixing step in the throughput priority mode in the embodiment 1.

FIG. 9 shows the transition of heater control temperature and pressure roller temperature in the throughput priority mode performing the above control. Moreover, FIG. 9 shows the transition of heater control temperature and pressure roller temperature in the curl reduction mode as a reference. At the time of switching temperatures in the throughput priority mode, paper conveyance interval temperature becomes temporarily higher than fixing temperature. However, this is only a temporary state, the difference between pressure roller temperature and fixing temperature does not become sufficiently small.

The difference between pressure roller temperature and fixing temperature under paper conveyance in the throughput priority mode is small compared to the case of the curl priority mode. When continuously fixing 100 sheets under conditions of air temperature of 30° C. and humidity of 80%, curl and loading characteristic are impaired.

Therefore, even if the temperature control of a fixing apparatus for switching fixing temperature and paper conveyance interval temperature is performed, sufficient curl reduction effect cannot be obtained unless control is performed like the case of the curl reduction mode of this embodiment.

For example, when continuously fixing a sheet (hereafter referred to as small size) having a width smaller than that of maximum-size recording medium which can be used by a fixing apparatus, a paper conveyance interval is made longer than the case of the throughput priority mode and paper conveyance interval temperature is made lower than fixing temperature. In general, when continuously fixing small sizes, an area with which the recording medium of a pressure roller (no-paper conveyance portion) contacts rises in temperature because heat is not robbed and the no-paper conveyance portion become a high temperature. As described above, by setting paper conveyance interval temperature to a temperature lower than fixing temperature, it is possible to lower the no-paper conveyance portion and moderate temperature rise of an end of the pressure roller in a paper conveyance interval.

In this case, however, because this is not the control for raising the temperature of the pressure roller in the paper conveyance interval and lowering the fixing temperature under paper conveyance, curl reduction effect is not obtained differently from the case of the curl reduction mode.

As described above, by setting the target temperature of a heating member in a paper conveyance interval to a temperature higher than the target temperature when heating a member to be heated, the temperature of a pressure member is raised in the paper conveyance interval and the temperature of the heating member is lowered when heating the member to be heated. Thereby, it is possible to restrain the warp and curl of the member to be heated by decreasing the difference between the surface temperature of the heating member when heating the member to be heated and the surface temperature of the pressure member and decreasing the difference between heat quantities to be conveyed from pressure member to the member to be heated.

Moreover, in the case of a fixing apparatus for heating and fixing a recording medium while holding and conveying the medium at the pressure-welding portion between a heating member having a heat generation source and a pressure member having no heat generation source, the paper conveyance interval temperature e is set to a temperature higher than the fixing temperature d. Thereby, even under a high-humidity environment or even when using a recording medium having a large water content or a recording medium weak in paper strength, it is possible to restrain the curl of a fixed recording medium. Therefore, it is possible to prevent drop from the loading face of an image forming apparatus, reversal of printing sequence, crease, corner breakage and a user can use a recording medium without the fact that the user corrects a strain or brings recording media into line.

Second Embodiment

Figure 10:
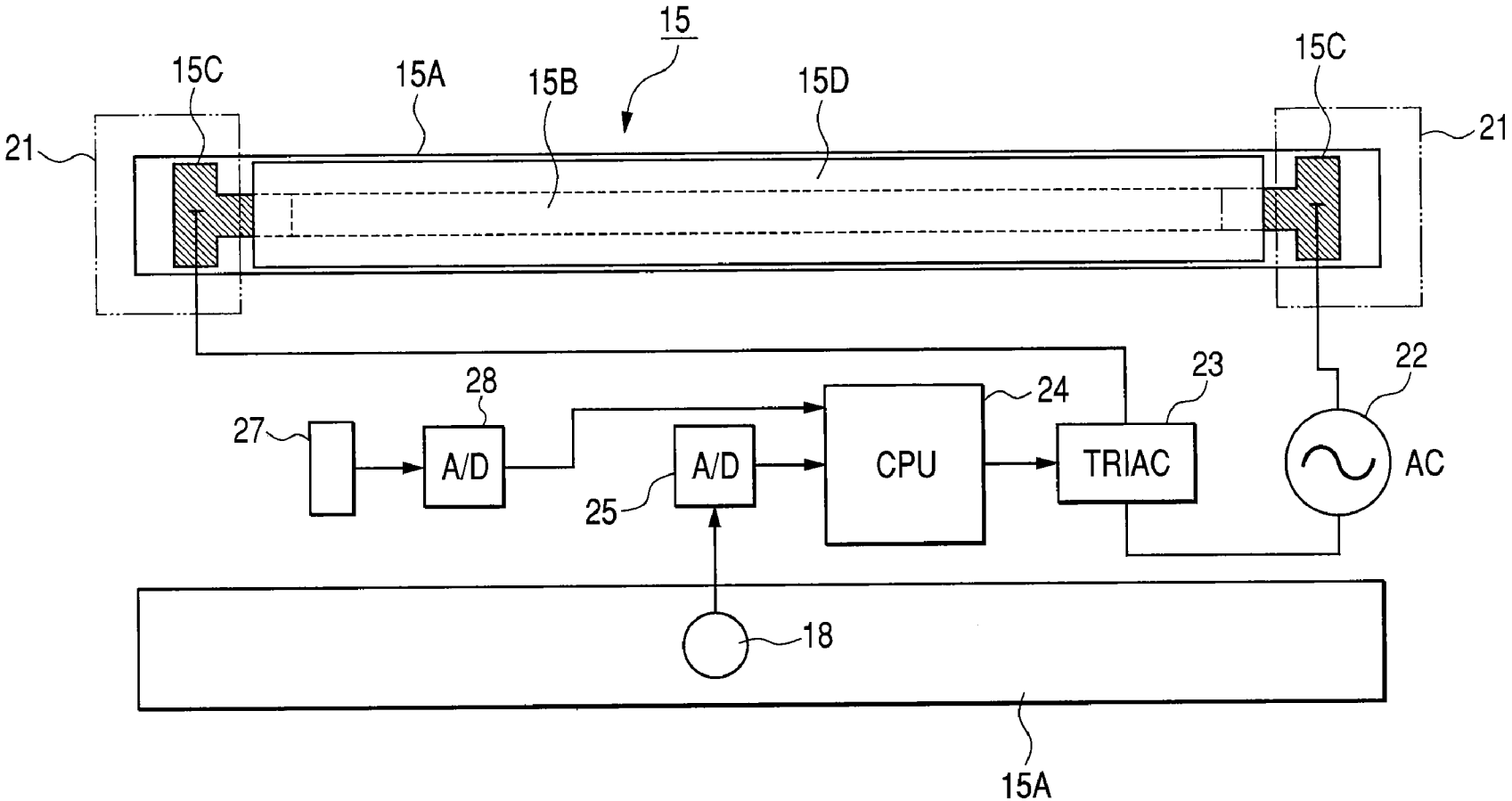
FIG. 10 is a block diagram of a heater temperature control system including water content detection means of a recording medium in embodiment 2.

A schematic configuration of the image forming apparatus of this embodiment is the same as the case of the embodiment 1. As shown in FIG. 10, recording-medium water-content detection means 27 for detecting the water content of a recording medium is used and power control means 24 changes the difference between the paper conveyance interval temperature e and the fixing temperature d and a paper conveyance interval length in accordance with the water content of the recording medium detected by the water-content detection means 27.

The electrical analog information on the recording-medium water content detected by the water-content detection means 27 is input to an analog-digital conversion circuit (A/D conversion circuit) 28 and digitized and input to the power control means 24.

The water-content detection means 27 of the recording medium P includes the electric resistance type, high-frequency resistance type, high-frequency capacity type and microwave type and it is allowed to use any water-content detection type. Moreover, for example, to simplify a configuration, it is allowed to use a method for applying voltage while holding and conveying a recording medium by conveying means and estimating the water content of the recording medium in accordance with a flowing current value. Moreover, it is allowed to use a method for estimating the water content of the recording medium P from a current flowing through a transfer member 6 when applying a voltage while transfer is performed by a transfer portion.

When a recording medium has a large water content, the water content evaporated during fixing also increases and the shrinkage value of the recording medium increases. Therefore, curl easily occurs and a curl reduction measure is necessary. However, when the water content decreases, curl does not easily occur and therefore, the curl reduction measure is unnecessary.

An experiment for confirming how the water content of the recording medium P influences curl and loading characteristic of a fixed recording medium was performed.

The recording media used for a paper conveyance experiment were Xerox 4024 paper which was left as it was under conditions of weighting capacity of 75 g/m2, air temperature of 30° C. and humidity of 80% and the recording media whose water contents were 4.0%, 7.0% and 10.0% were used.

Because an image forming apparatus used for the experiment has the same configuration as the case of the experiment 1 of the embodiment 1, description is omitted. The experiment was performed by setting the image forming apparatus under conditions of air temperature of 30° C. and humidity of 80%, fixing a fixing temperature to 180° C. and changing the difference between fixing temperature and paper conveyance interval temperature to 0° C., 5° C., 10° C. and 15° C. Moreover, 100 sheets are continuously fixed similarly to the case of the loading characteristic evaluation in "experiment 1" of the embodiment 1 by changing each paper conveyance interval length to 0.5 sec, 1 sec, 2 sec, 3 sec, 6 sec, 12 sec and 15 sec to evaluate the loading state of a fixed recording medium. Table 4 shows experiment results.

TABLE 4

| Paper conveyance interval temperature – Fixing temperature (° C.) | Water content of sheet | Paper conveyance interval length (sec.) 0.5 | 1.5 | 3.0 | 6.0 | 12 | 15 |
|---|---|---|---|---|---|---|---|
| 0 | 4.0% | GOOD | GOOD | GOOD | GOOD | GOOD | GOOD |
| | 7.0% | NG | NG | misalignment | misalignment | misalignment | misalignment |
| | 10.0% | NG | NG | NG | misalignment | misalignment | misalignment |
| 5 | 4.0% | | GOOD | GOOD | GOOD | GOOD | GOOD |
| | 7.0% | | misalignment | misalignment | misalignment | misalignment | misalignment |
| | 10.0% | | NG | misalignment | misalignment | misalignment | misalignment |
| 10 | 4.0% | | GOOD | GOOD | GOOD | GOOD | |
| | 7.0% | | GOOD | misalignment | misalignment | GOOD | |
| | 10.0% | | misalignment | misalignment | misalignment | GOOD | |
| 15 | 4.0% | | | GOOD | GOOD | | |
| | 7.0% | | | misalignment | GOOD | | |
| | 10.0% | | | misalignment | GOOD | | |
| 20 | 4.0% | | | GOOD | | | |
| | 7.0% | | | GOOD | | | |
| | 10.0% | | | GOOD | | | |

As a water content decreases, a loading characteristic is improved. A recording medium having a large water content tends to have a bad loading characteristic. In the case of a recording medium having a water content of 4.0%, the loading characteristic was preferable even when the difference between paper conveyance interval temperatures was 0° C. and the paper conveyance interval length was 0.5 sec.

When using the above recording medium, it is advantageous for a user to decrease the difference between the paper conveyance interval temperature e and the fixing temperature d, decrease a paper conveyance interval and anticipate throughput.

A recording medium having a water content of 10.0% is easily curled and when performing control by setting the difference between the paper conveyance interval temperature e and the fixing temperature e to 0° C. and the paper conveyance interval length to 0.5 sec, fixed recording media were rounded and dropped from a loading tray 14 one after another. Moreover, they were firmly rounded and therefore, they could not be directly used. In this case, even if the time until continuous fixing is completed is short, a user must perform extra operations such as alignment of recording media and correction of strain.

When setting the difference between the paper conveyance interval temperature e and the fixing temperature d to 20° C. and increasing a paper conveyance interval length to 3.0 sec, it was possible to restrain curl and load 100 sheets in good alignment. Though the time until continuous fixing is completed is increased, a user can immediately use output records with no stress.

As known from the above experiment, it is possible to maximally anticipate throughput and perform optimum control for the state of a recording medium used by a user while keeping curl and loading characteristic preferably by a method for changing the difference between the fixing temperature d and the paper conveyance interval temperature e in accordance with a water content.

That is, a user can use a recording sheet output at a high quality with no stress without performing extra operations such as correction of strain and alignment of recording media by applying curl reduction measure to a sheet having bad curl as shown in Table 5. Moreover, it is possible to quickly provide a recording sheet which is not easily curled for a user at quick throughput.

TABLE 5

| Water content | Paper conveyance interval length (sec.) | Paper conveyance interval temperature – Fixing temperature (° C.) |
|---|---|---|
| -4% | 0.5 | 0 |
| 4-10% | 1.5 | 10 |
| 10%- | 3.0 | 15 |

As described above, the water content of a recording medium is detected to set the difference between the target temperature of a heating member in a paper conveyance interval and a target temperature at the time of heating. Thereby, in the case of a recording material which has less water content and is not easily curled, it is possible to anticipate the throughput for heating by decreasing the difference between paper conveyance interval temperature and fixing temperature and smoothly switching a paper conveyance interval and heating. Moreover, in the case of a recording material which is easily curled, it is possible to restrain the warp and curl of a recording material by increasing the difference between paper conveyance interval temperature and fixing temperature and perform optimum temperature control in accordance with the state of the recording material.

Third Embodiment

Figure 11:
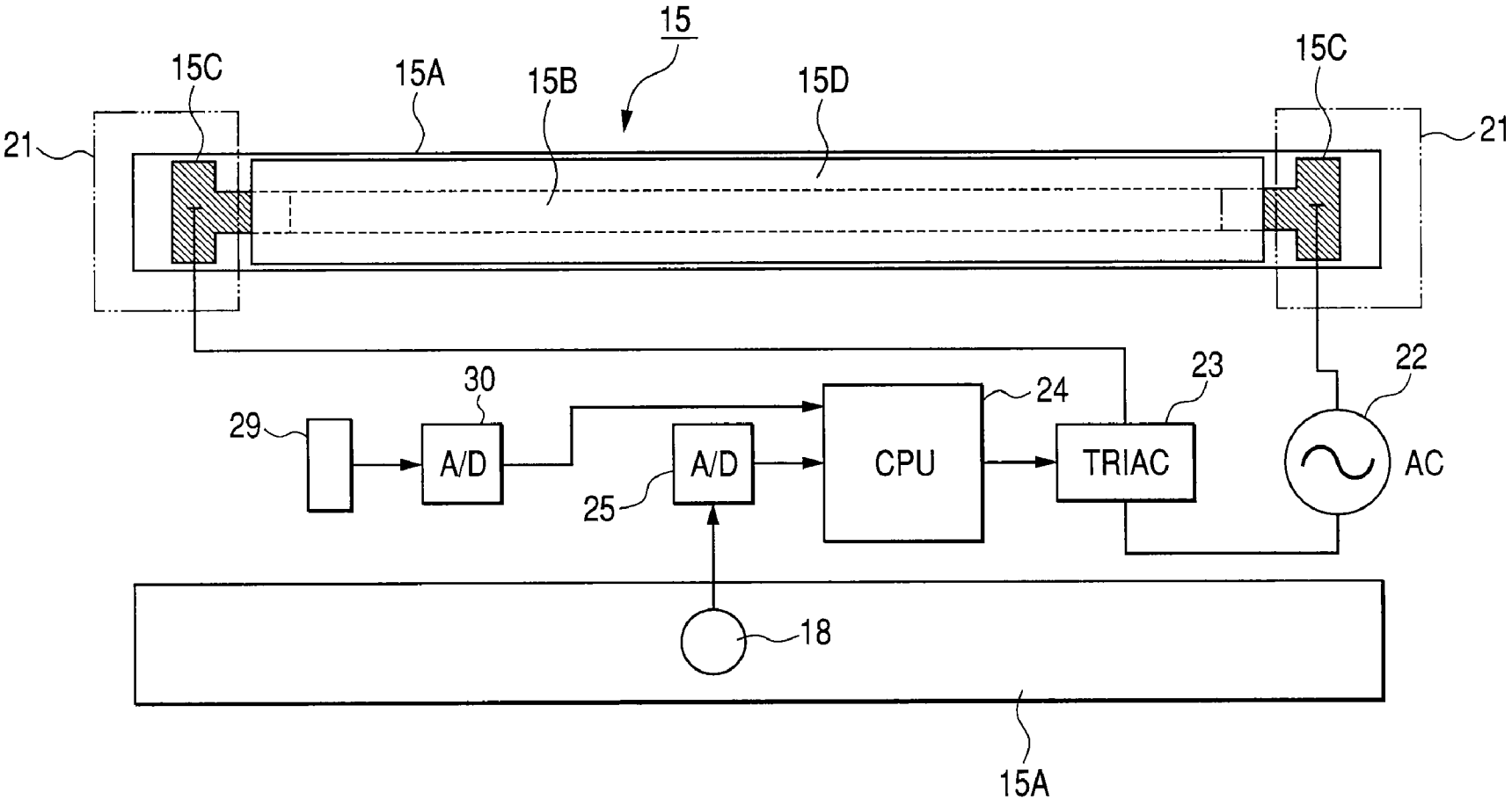
FIG. 11 is a block diagram of a heater temperature control system including environment detection means in embodiment 3.

A schematic configuration of the image forming apparatus of this embodiment is the same as the case of the embodiment 1. As shown in FIG. 11, this embodiment is provided with environment detection means 29 for detecting the temperature or humidity of the environment in which the image forming apparatus is set or both of the temperature and humidity and power control means 24 changes the difference between the paper conveyance interval temperature e and the fixing temperature d and a paper conveyance interval length in accordance with a detection result by the environment detection means 29.

Electrical analog information on the temperature or humidity of the environment detected by the environment detection means 29 or both of the temperature and humidity is input to an analog-digital conversion circuit (A/D conversion circuit) 30, digitized and input to the power control means 24.

A sheet used for an image forming apparatus set in a high-temperature high-humidity environment may be a humidified sheet familiarized in the high-temperature high-humidity environment.

Water contents of sheets which were left as they were for three days from a high-temperature high-humidity environment to a low-temperature low-humidity environment were measured.

a: The water content of a sheet which was left as it was in an environment having air temperature of 32° C. and humidity of 80% was 11.0%.

b: The water content of a sheet which was left as it was in an environment having air temperature of 25° C. and humidity of 50% was 7.0%.

c: The water content of a sheet which was left as it was in an environment having air temperature of 15° C. and humidity of 10% was 3.5%.

It is found that the water content of the sheet left as it was in the environment having air temperature of 32° C. and humidity of 80% in the above Item "a" is large and the sheet is easily curled from the experiment result of the embodiment 1. It is found that the water content of the sheet which was left as it was in the environment having air temperature of 15° C. and humidity of 10% is large and the sheet is not easily curled from the experiment result of the embodiment 2.

That is, as shown in Table 6, curl reduction measure is applied to sheets whose curls are bad and a user can use a recording sheet output at a high quality with no stress without performing extra operations such as correction of strain and alignment of recording materials. Moreover, it is possible to quickly provide a recording sheet which is not easily curled to a user at quick-throughput.

TABLE 6

| Environment | Paper conveyance interval length (sec.) | Paper conveyance interval temperature – Fixing temperature (° C.) |
|---|---|---|
| Humidity of 20% or less | 0.5 | 0 |
| Humidity between 20 and 75% | 2.0 | 10 |
| Air temperature of 75° C. or higher | 3.0 | 15 |

For this embodiment, an example of detecting both temperature and humidity is described. However, sufficient advantage is obtained by detecting only humidity because a recording medium familiarized in a high-humidity environment has more water content.

Moreover, because a high-humidity environment has a high absolute humidity compared to a case in which humidity is low, a recording medium familiarized in a high-temperature environment may have a large water content. There is an advantage though only detection of temperature is not sufficient.

For this embodiment, an example of using a temperature sensor and humidity sensor as the environment detection sensor 27 is described. However, the same advantage is obtained by using a method for estimating an environment in accordance with resistance value fluctuation of an ion conductive transfer member without using a sensor.

As described above, the following advantage is obtained by setting the difference between the target temperature of a heating member in a paper conveyance interval and a target temperature at the time of heating. That is, in the case of an environment in which a recording material is not easily curled, it is possible to anticipate the throughput for heating by decreasing the difference between paper conveyance interval temperature and fixing temperature and smoothly switching a paper conveyance interval and heating. Moreover, in the case of an environment in which a recording material is easily curled, it is possible to restrain the warp and curl of the recording material by increasing the difference between paper conveyance interval temperature and fixing temperature and perform optimum temperature control in accordance with an environment in which a heating apparatus is set.

Fourth Embodiment

Figure 12:
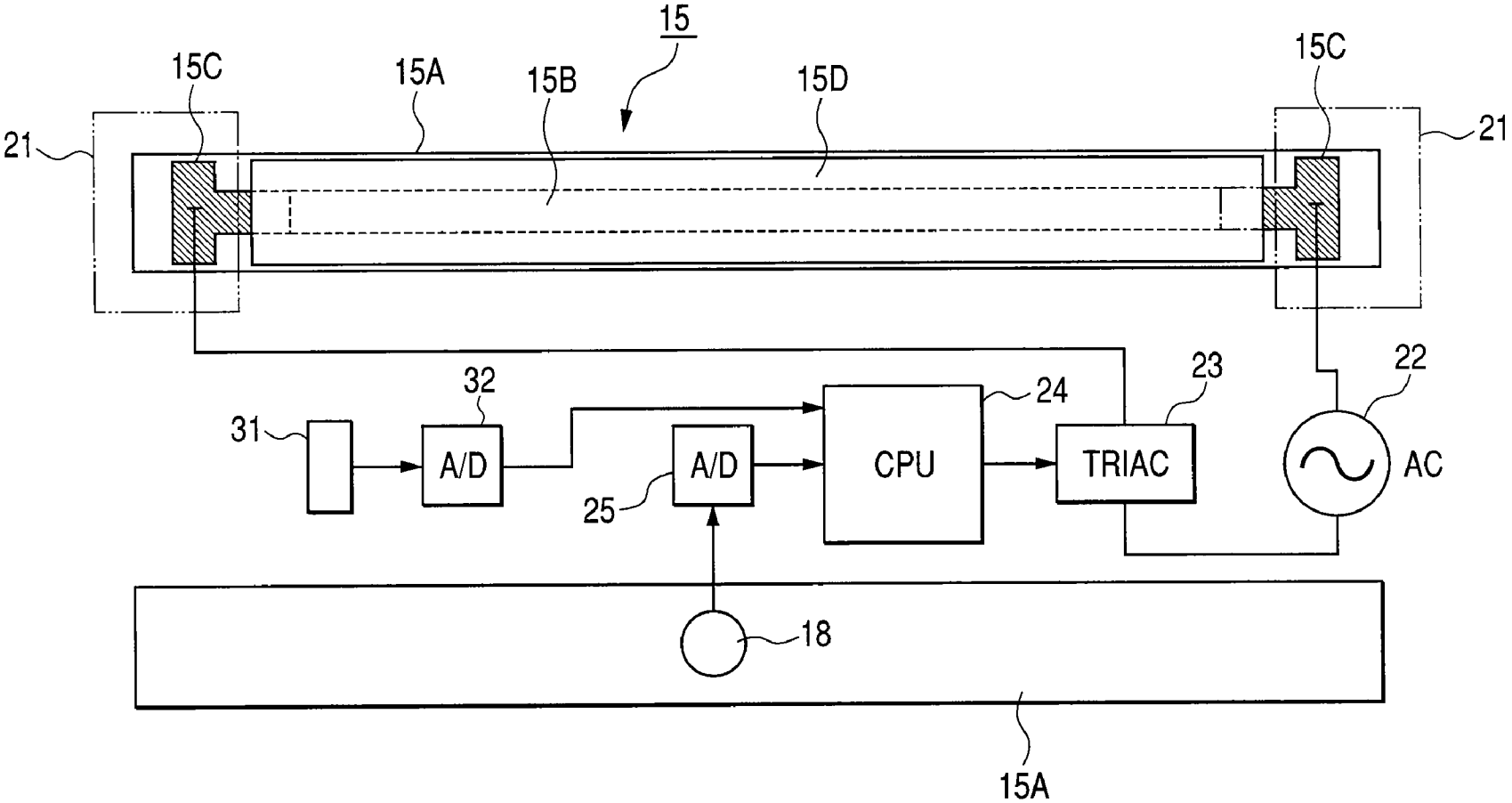
FIG. 12 is a block diagram of a heater temperature control system including detection means for detecting the thickness or type or the both of the them of a recording medium in embodiment 4.

A schematic configuration of the image forming apparatus of this embodiment is the same as the case of the embodiment 1. As shown in FIG. 12, this embodiment has recording medium detection means 31 for detecting the thickness or type of a recording medium or both of them and power control means 24 changes the difference between paper conveyance interval temperature and fixing temperature and a paper conveyance interval length in accordance with the thickness or type of the recording medium detected by the detection means 31 or both of them.

The electrical analog information on the thickness or type of the recording medium detected by the detection means 31 or both of them is input to an analog-digital conversion circuit (A/D conversion circuit) 32, digitized and input to power control means 24.

The detection means 31 for detecting the thickness or type of a recording medium includes a contact type for measuring thickness and surface roughness and making determination by contacting, for example, a sensor and a non-contact optical type for illuminating rays, measuring thickness and surface roughness from reflected light and making determination. It is allowed to use any detection means.

An experiment for confirming how the thickness or type of a recording medium influences the curl of the fixed recording medium was performed.

The recording media used for paper conveyance experiment are those which were left as they were for three days under an environment having air temperature of 30° C. and humidity of 80% after taking them out from packing paper.

A loading state of fixed recording media was evaluated by continuously fixing 100 recording media similarly to the case of loading characteristic evaluation of "Experiment 1" in the embodiment 1 on the following cases:

a case in which the difference between fixing temperature d and paper conveyance interval temperature e is set to 0° C. and an paper conveyance interval length is increased up to 0.5 sec, a case in which the difference between the fixing temperature d and the paper conveyance interval temperature e is set to 10° C. and the paper conveyance interval length is increased up to 1.5 sec and a case in which the difference between the fixing temperature d and the paper conveyance interval temperature e is set to 20° C. and the paper conveyance interval length is increased up to 3.0 sec. The experimental results are shown in Table 7.

TABLE 7

| | | | Paper conveyance interval length (sec.) | | |
|---|---|---|---|---|---|
| | | | 0.5 | 1.5 | 3.0 |
| | | | Paper conveyance interval temperature – Fixing temperature (° C.) | | |
| | | | 0 | 5 | 3.0 |
| Office Planner | Weighting capacity 64 g/m$^2$ | Smooth paper | NG | NG | GOOD |
| XEROX4024 | Weighting capacity 75 g/m$^2$ | Smooth paper | NG | misalighnment | GOOD |
| XEROX4424 | Weighting capacity 90 g/m$^2$ | Smooth paper | misalighnment | GOOD | GOOD |
| XEROX4024 | Weighting capacity 105 g/m$^2$ | Smooth paper | GOOD | GOOD | GOOD |
| XEROX4024 | Weighting capacity 163 g/m$^2$ | Smooth paper | GOOD | GOOD | GOOD |
| Badger Bond | Weighting capacity 60 g/m$^2$ | Bond paper | NG | NG | GOOD |
| EN 100 | Weighting capacity 64 g/m$^2$ | Recycle paper | NG | NG | GOOD |
| Steinbeis | Weighting capacity 80 g/m$^2$ | Recycle paper | NG | NG | GOOD |
| Fox River Bond | Weighting capacity 90 g/m$^2$ | Bond paper | misalighnment | GOOD | GOOD |
| Fox River Bond | Weighting capacity 105 g/m$^2$ | Bond paper | GOOD | GOOD | GOOD |

As a result of the experiment, the type of paper having a large weighing capacity tends to have less curl and the type of paper having a small weighing capacity tends to be improved in curl. Moreover, in the case of types of paper, there is a trend in which curl is bad for the Bond paper and recycle paper.

In the case of the smooth paper, the curl of the type of paper having a weighting capacity of 64 g/m$^2$ is particularly bad and the curl of recording paper output in accordance with temperature control in which the difference between the fixing temperature d and the paper conveyance interval temperature e is 0° C. was rounded and it could not be used. In the case of the control in which the difference between fixing temperature and paper conveyance interval temperature is increased up to 15° C. and a paper conveyance interval is increased, it was possible to restrain curl. However, in the case to the type of paper equal to or more than 150-g paper, curl was not bad even in the case of the control in which the difference between fixing temperature and paper conveyance interval temperature is 0° C. and a paper conveyance interval is decreased up to 0.5 sec. In the case of unsmooth paper such as Bond paper or recycle paper, there was a trend in which curl is not good for the type of paper equal to or less than 80-g paper. Also in this case, it was possible to restrain curl in the case of the control in which the difference between fixing temperature and paper conveyance interval temperature is increased up to 20° C. and a paper conveyance interval is increased to 3.0 sec.

As known from the above experiment result, by detecting the thickness or the type of paper of a recording medium and deciding smooth paper or unsmooth paper by determining a weighting capacity, the difference between the fixing temperature d and the paper conveyance interval temperature e and a paper conveyance interval length are changed. Thereby, it is possible to apply optimum control to a state of a recording medium to be used by a user by maximally anticipating throughput while preferably maintaining curl.

That is, as shown in Table 8, curl reduction measure is applied to a sheet whose curl is bad and a user can use recording paper output at a high quality with no stress without performing correction of strain or alignment of recording materials. Moreover, it is possible to quickly provide recording paper which is not easily curled to a user at a quick throughput.

TABLE 8

| Type of paper | Weighting capacity | Paper conveyance interval length (sec.) | Paper conveyance interval temperature – Fixing temperature (° C.) |
|---|---|---|---|
| Smooth paper | −64 g/m$^2$ | 3.0 | 20 |
| | 64 g/m$^2$-90 g/m$^2$ | 1.5 | 10 |
| | 90 g/m$^2$- | 0.5 | 0 |
| Unsmooth paper | −80 g/m$^2$ | 3.0 | 20 |
| | 80 g/m$^2$- | 1.5 | 10 |
| | 90 g/m$^2$- | 0.5 | 0 |

As described above, in the case of this embodiment, the difference between target temperature of a heating member in a paper conveyance interval and target temperature at the time of heating is set in accordance with the thickness or type of a recording material. Thereby, in the case of a recording material which is not easily curled, it is possible to anticipate throughput by decreasing the difference between paper conveyance interval temperature and fixing temperature and smoothly switching a paper conveyance interval and heating. Moreover, in the case of a recording material which is easily curled, it is possible to restrain warp and curl of the recording material by increasing the difference between paper conveyance interval temperature and fixing temperature and perform optimum temperature control in accordance with a state of the recording material.

Fifth Embodiment

Figure 13:
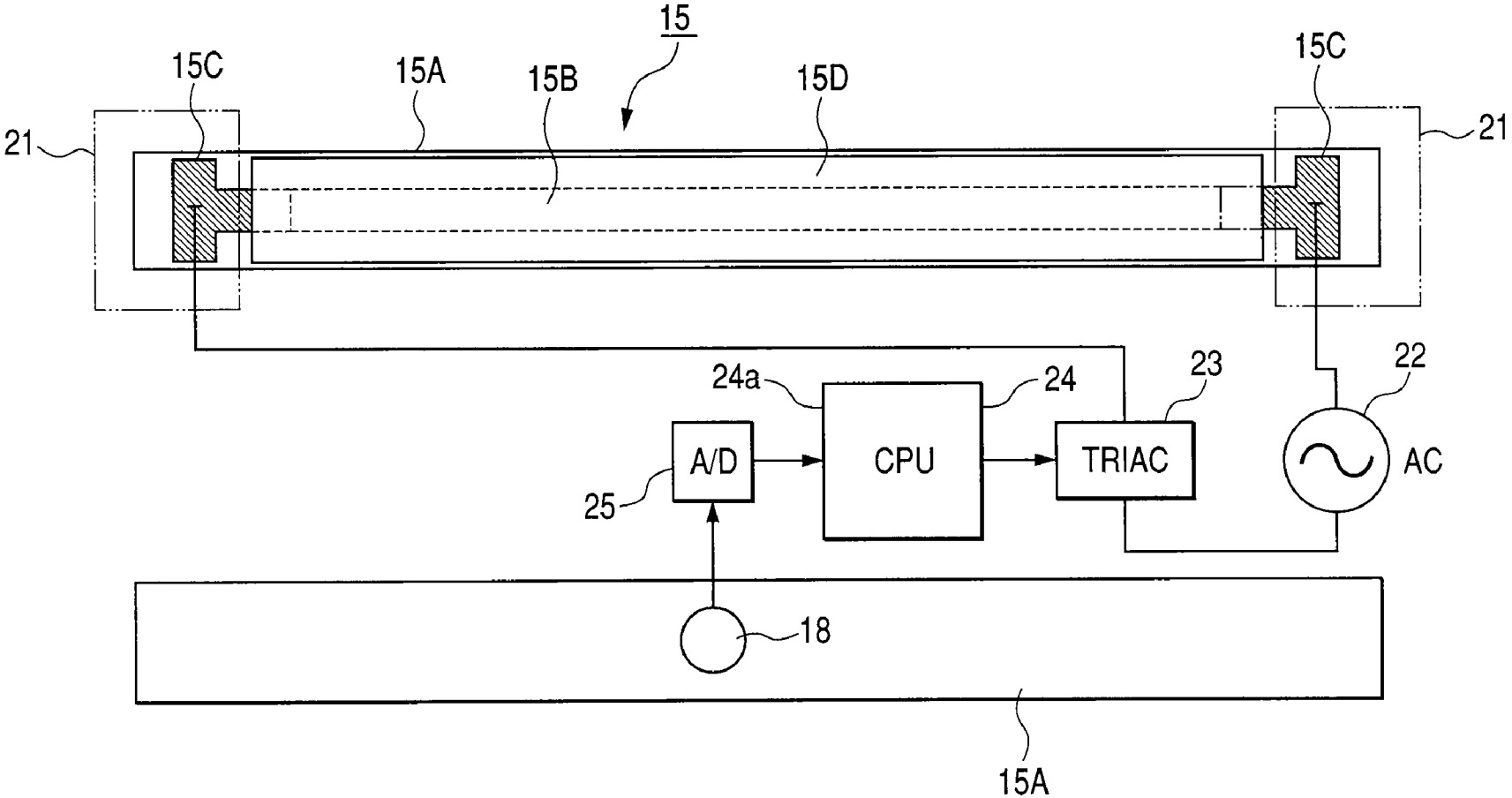
FIG. 13 is a block diagram of a heater temperature control system including a counter function portion for counting the number of sheets continuously fixed in embodiment 5.

A schematic configuration of the image forming apparatus of this embodiment is the same as the case of the embodiment 1. As shown in FIG. 13, in the case of this embodiment, a counter function portion 24*a* for counting the number of continuously fixed sheets is provided for the power control means 24 to change the difference between paper conveyance interval temperature e and fixing temperature d and the power control means 24 changes the difference between paper conveyance interval temperature e and fixing temperature d and a paper conveyance interval in accordance with the number of continuously fixed sheets counted by the counter function portion 24*a*.

From the study by the present inventor, it is found that the curl of a first fixed recording sheet is smaller than the curl of the tens-th fixed recording sheet.

By decreasing a paper conveyance interval to 0.5 sec, equalizing the paper conveyance interval temperature e with the fixing temperature d and continuously fixing 100 sheets similarly to the case of the loading characteristic evaluation of "experiment 1" in the embodiment 1, the loading state of fixed recording media was evaluated.

TABLE 9

| Number of continuously fixed sheets | 1 to 2 | 3 to 4 | 5 or more |
|---|---|---|---|
| Loading characteristic | GOOD | misalignment | NG |

Figure 14:
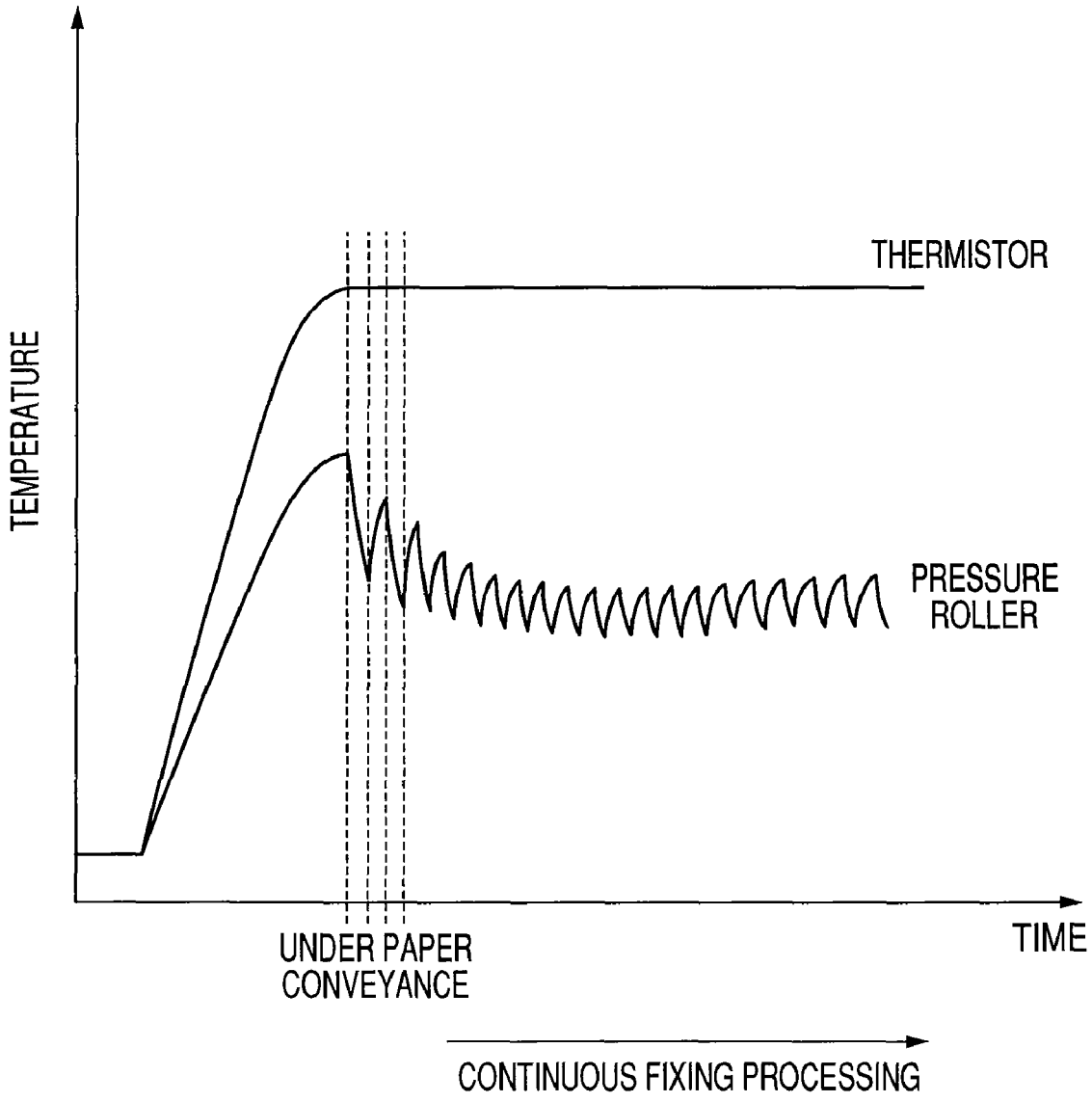
FIG. 14 is an illustration showing a transition of thermistor detection temperature and pressure-roller surface temperature in a continuous fixing step.

Moreover, FIG. 14 shows transition of pressure roller temperature in the case of the above experiment. When the first sheet was fixed, the temperature of the surface of a pressure roller is was high and the difference between heater temperature and pressure-roller surface temperature was comparatively small. Thereafter, the pressure-roller surface temperature is lowered every paper conveyance. This is because there is a period for raising the heater temperature up to a target temperature before fixing a first sheet, the pressure roller surface temperature rises. However, because a paper conveyance interval is short on and after a second sheet and the heat quantity taken by a recording medium under paper conveyance is larger than the heat quantity supplied to the pressure roller in the paper conveyance interval, the pressure roller surface temperature is lowered. Therefore, the curl of continuously fixed recording sheets is the best in the beginning. Thereafter, though the pressure roller temperature is slightly raised, it is not sufficiently raised unless a lot of sheets are conveyed. A lot of recording sheets having bad curl and loading characteristic are output.

Therefore, in the case of this embodiment, the difference between the paper conveyance interval temperature e and the fixing temperature d and a paper conveyance interval are changed. For example, as shown in Table 10, fixing control is performed.

TABLE 10

| Number of continuously fixed sheets | 1 to 2 | 3 to 4 | 5 or more |
|---|---|---|---|
| Difference between paper conveyance interval temperature and fixing temperature (° C.) | 0 | 10 | 15 |
| Paper conveyance interval length | 0.5 | 1.5 | 3.0 |

In the fixing control in Table 10, 100 recording media are continuously fixed similarly to the case of the loading characteristic evaluation of "experiment 1" in the embodiment 1 to evaluate the loading state of them. Table 11 shows experiment results.

TABLE 11

| Number of continuously fixed sheets | 1 to 2 | 3 to 4 | 5 or more |
|---|---|---|---|
| Loading characteristic | GOOD | GOOD | GOOD |

As known from the above experiment results, in the case of the fixing control in this embodiment, the fixing control giving priority to throughput is performed in the beginning in which curl and loading characteristic are good when starting continuous fixing and it is possible to quickly provide an output image to a user who fixes a small number of sheets.

By increasing a paper conveyance interval and setting the difference between fixing temperature and paper conveyance interval temperature to a large value in accordance with the number of sheets, curl is not deteriorated, drop of a recording sheet or reversal of output sequence do not occur even if a lot of recording sheets are output to the loading portion of an image forming apparatus and it is possible to align and load the recording sheets. Therefore, a user who fixes a lot of sheets can use recording sheets output at a high quality with no stress without performing extra operations such as correction of strain and alignment of recording materials.

As described above, in the case of this embodiment, the number of continuously heated sheets is counted and the difference between target temperature of a heating member in a paper conveyance interval and target temperature at the time of heating is set. Thereby, while the number of printed sheets is small and the number of discharged and loaded recording materials is small, it is possible to anticipate the throughput for heating by decreasing the difference between paper conveyance interval temperature and fixing temperature and smoothly switching a paper conveyance interval and heating. However, when the number of printed sheets increases and the number of discharged and loaded printing materials increases, it is possible to perform temperature control optimum for loading recording materials by increasing the difference between paper conveyance interval temperature and fixing temperature.

Sixth Embodiment

A schematic configuration of an image forming apparatus on this embodiment is the same as the case of the embodiment 1. However, this embodiment uses a heat-roller-type fixing apparatus.

In the case of the embodiment 1, an example for a laser beam printer having the film-heating-type fixing apparatus 7 is described. To perform the control for changing heater temperatures in a paper conveyance interval during fixing, the film heating type is preferable because the heat capacity of the ceramic heater 15 serving as heating means is small and the accuracy and response characteristic of temperature control are preferable. However, even if the present invention uses other fixing type such as the heat roller type, when it is possible to raise the surface temperature of a heat roller (fixing roller) serving as a heating member in a paper conveyance interval and lower the surface temperature during fixing similarly to the case of embodiments 1 to 5, it is clear from the experiment results of the embodiment 1 than the same advantage can be obtained.

Figure 15:
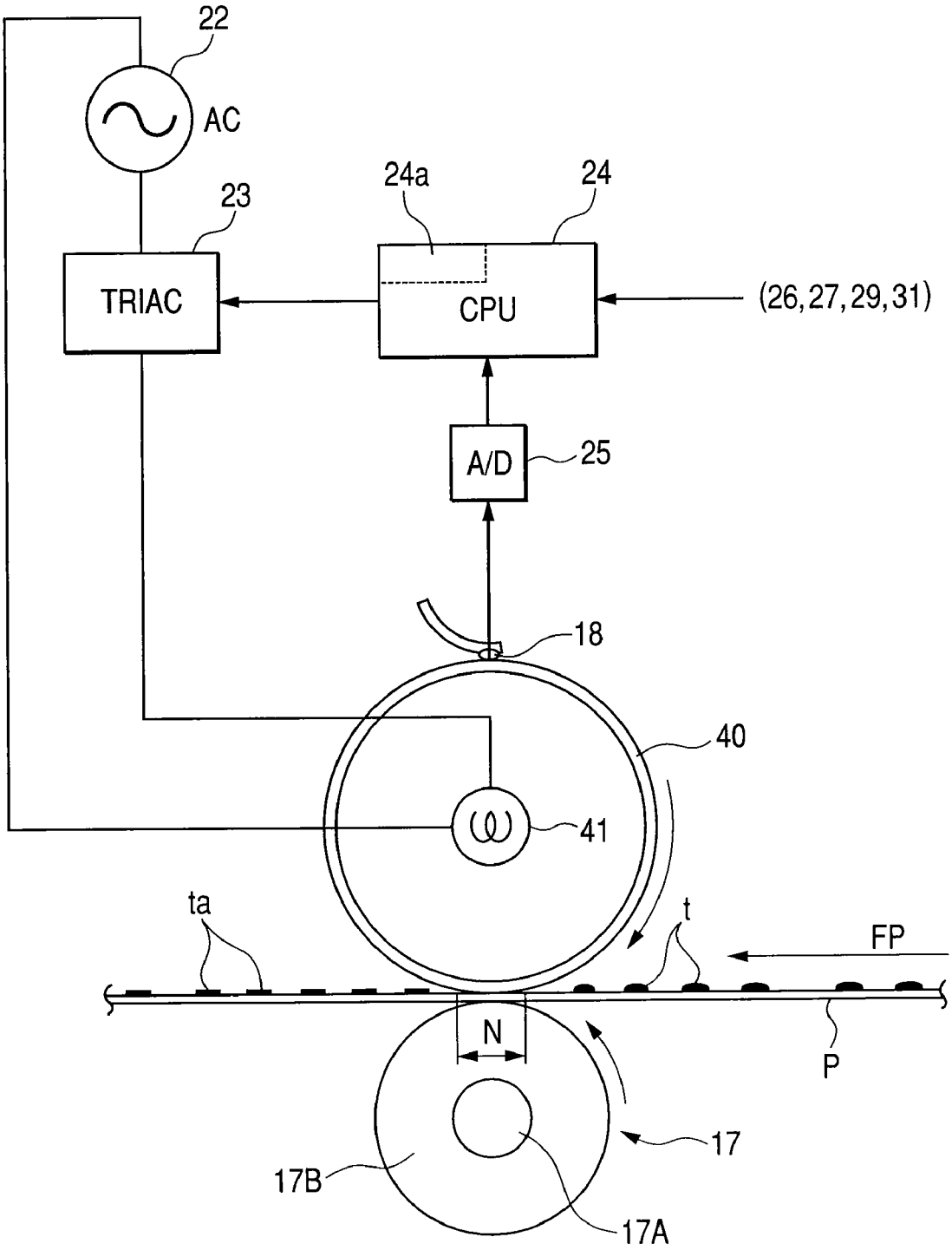
FIG. 15 is a schematic sectional view showing a schematic configuration of a heat-roller-type fixing apparatus in embodiment 6.
Figure 16:
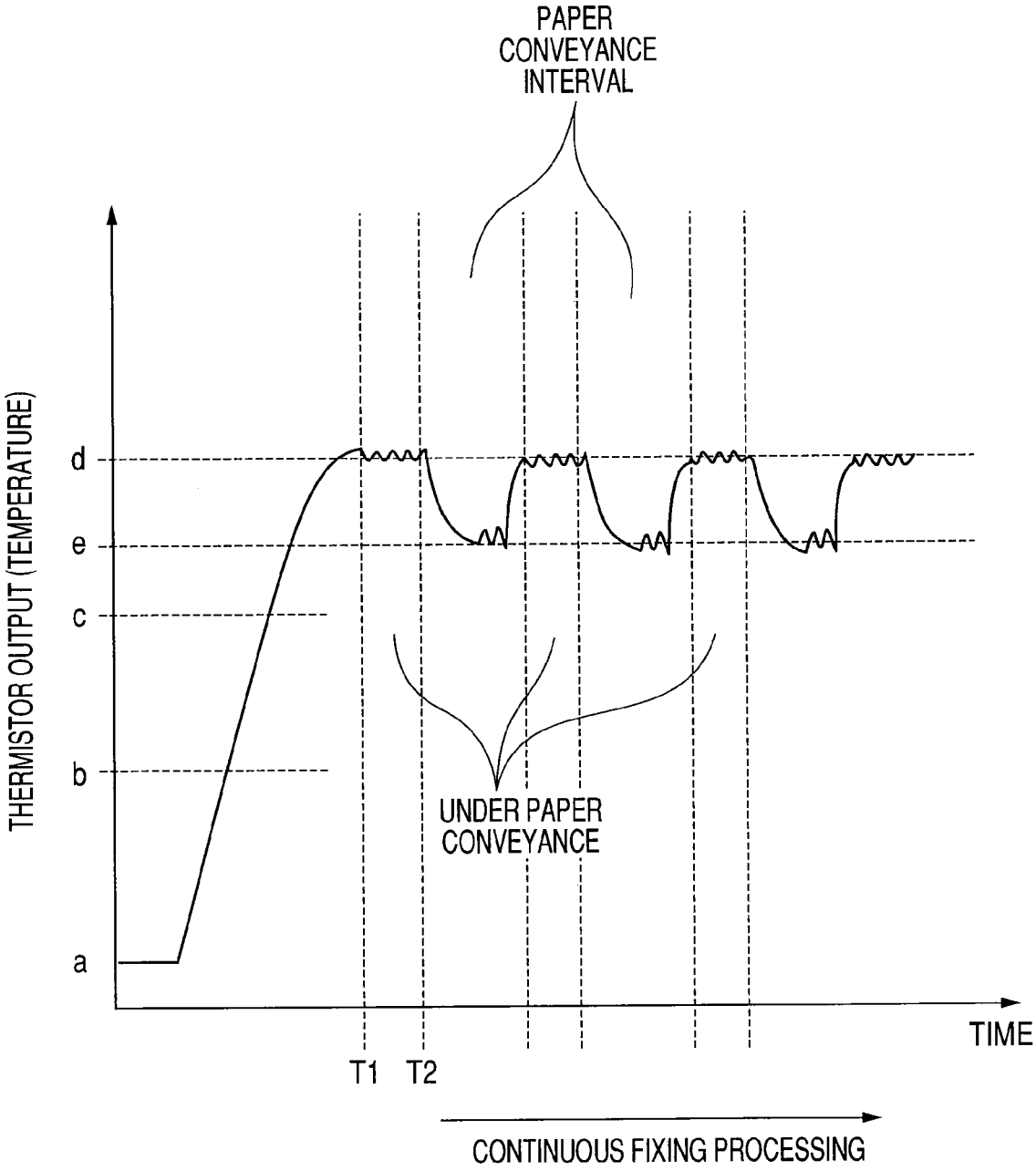
FIG. 16 is an illustration showing a transition of thermistor detection temperature in a conventional continuous fixing step.

A heat-roller-type fixing apparatus has the configuration shown in FIG. 15. That is, a heating source 41 such as a halogen heater is set to the inside of a fixing roller 40 obtained by forming a mold release layer made of fluorine resin on the surface of a cylindrical member made of metal to perform electrification control in accordance with a temperature detected by a thermistor 18 contacting with the fixing roller 40.

Because the heat capacity of a fixing roller is conventionally larger than the case of the film heating type, it is disadvantageous to perform temperature control in which target temperatures are frequently switched. However, in recent years, a fixing roller is also realized which makes quick temperature rise possible by using a thin fixing roller 40 and decreasing heat capacity. This fixing apparatus of this type is preferable to execute the present invention similarly to the case of the film heating type and can perform the control same as the control by each of the embodiments 1 to 5.

[Others]

1) In the case of a film-heating-type heating apparatus, it is a matter of course that the ceramic heater 15 serving as heating means is not restricted to configurations of embodiments. It is also allowed to use the so-called back-surface-heating-type (back side) ceramic heater obtained by setting an exothermic resistor on the face opposite to the face at the side on which a flexible member of a heater substrate slides. It is also possible to use a heater obtained by covering the surface of a metallic plate with an insulating material instead of ceramic insulating substrate.

Moreover, heating means is not restricted to a ceramic heater. For example, it is also possible to use an electromagnetic-induction exothermic member.

It is possible to use internal heating type or external heating type to heat a flexible member by heating means. Moreover, it is possible to use an apparatus configuration for detecting the temperature of the flexible member by a temperature detector.

It is also possible to form the flexible member into a configuration for generating heat by exciting means by forming it into an electromagnetic induction member.

A driving system of a flexible member is not restricted to the pressure member driving system of the embodiments. It is also allowed to use an apparatus configuration for driving a flexible member while applying tension to an endless flexible member by setting a driving roller to the inner periphery of the flexible member or it is possible to realize an apparatus configuration for moving a flexible member by forming the member like a roller-wound end-present web while repeating this operation.

It is also possible to form a pressure member into not only a roller member but also belt member.

2) In the case of a roller-heating-type heating apparatus, it is possible to use the internal heating system or external heating system to heat a heat roller by heating means.

Heating means is not restricted to a halogen heater. It is also possible to realize a configuration for producing heat by excitation means by forming a heat roller into an electromagnetic induction member.

It is also possible to form a pressure member into not only a roller member but also a belt member.

3) A temperature detector is not restricted to a thermistor. It is also possible to use contact type or non-contact type.

4) In the case of the present invention, a heating apparatus is not restricted to film-heating-type or roller-heating-type apparatus. It is allowed to use a heating apparatus having a heating member and a pressure member which are pressure-welded each other to hold and convey a member to be heated by a nip portion and heat it.

A heating apparatus of the present invention is not restricted to a fixing apparatus of an embodiment. It can be also used as an image heating apparatus for performing temporary fixing, image heating apparatus for reheating a recording medium carrying an image to improve a surface characteristic such as luster and heating apparatus for drying, heating laminate, thermal press crease removal and thermal press curl removal.

This application claims priority from Japanese Patent Application No. 2004-259916 filed on Sep. 7, 2004, which is hereby incorporated by reference herein.

What is claimed is:

1. An image forming apparatus comprising:

an image forming part for forming an image on a recording material;

a fixing part for fixing the image formed on the recording material, said fixing part includes a heating member, and a pressure member that forms a nip portion with said heating member to pinch and convey the recording material; and a power supply controller for controlling an electrical power supply to said heating member so that the temperature of said heating member is maintained at a target temperature;

wherein in a case where images are continuously formed on a plurality of the recording materials, said apparatus has a first fixing treating mode in which the target temperature at the nip portion during an interval between a proceeding recording material and a recording material just following the proceeding recording material is lower than or equal to the target temperature when a recording material is just passing through the nip potion, and a second fixing treating mode in which the target temperature at the nip portion during an interval between the proceeding recording material and the recording material just following the proceeding recording material is higher than the target temperature when a recording material is just passing through the nip potion, and wherein the time period between the proceeding recording material and the recording material just following the proceeding recording material when the apparatus is set in the second fixing treating mode is longer than the time period between the proceeding recording material and the recording material just following the proceeding recording material when the apparatus is set in the first fixing treating mode.

2. An image forming apparatus according to claim 1, further comprising means for detecting a water content of the recording material, wherein in the second fixing treating mode, a temperature difference between the target temperature at the nip portion in an interval between the proceeding recording material and the recording material just following the proceeding recording material and the target temperature when the recording material is just passing through the nip potion is set according to the water content detected by said means for detecting a water content of the recording material.

3. An image forming apparatus according to claim 1, further comprising means for detecting a temperature and/or a humidity of an environment, wherein in the second fixing treating mode, a temperature difference between the target temperature at the nip portion in an interval between the proceeding recording material and the recording material just following the proceeding recording material and the target temperature when the recording material is just passing through the nip potion is set according to the temperature and/or humidity of the environment detected by said means for detecting a temperature and/or a humidity of an environment.

4. An image forming apparatus according to claim 1, further comprising means for detecting a thickness and type of the recording material, wherein in the second fixing treating mode, a temperature difference between the target temperature at the nip portion in an interval between the proceeding recording material and the recording material just following the proceeding recording material and the target temperature when the recording material is just passing through the nip potion, is set according to the thickness and/or type of the recording material detected by said means for detecting a thickness and/or type of the recording material.

5. An image forming apparatus according to claim 1, further comprising a counter for counting a number of the recording materials, wherein in the second fixing treating mode, a temperature difference between the target temperature at the nip portion in an interval between the proceeding recording material and the recording material just following the proceeding recording material and the target temperature when the recording material is just passing through the nip potion, is set according to the number of the recording materials counted by said counter.

6. An image forming apparatus according to claim 1, wherein said heating member has a ceramic heater and a flexible member sliding on said ceramic heater, and the nip portion is formed by said ceramic heater and the pressure member through said flexible member.

7. An image forming apparatus according to claim 1, wherein said heating member is a heat roller including a heat source therein.

* * * * *